US005898443A

United States Patent [19]

Yoshino et al.

[11] Patent Number: 5,898,443

[45] Date of Patent: Apr. 27, 1999

[54] INK-JET PRINTING APPARATUS AND METHOD FOR TEST PRINTING USING INK AND AN INK IMPROVING LIQUID

[75] Inventors: Hiroshi Yoshino, Yokohama; Makoto Torigoe, Tokyo; Shigeyasu Nagoshi, Yokohama; Hiroshi Tajika, Yokohama; Hitoshi Sugimoto, Yokohama; Koichiro Kawaguchi, Yokohama, all of Japan

[73] Assignee: Canon Kabushiki Kaisha, Tokyo, Japan

[21] Appl. No.: 08/520,296

[22] Filed: Aug. 28, 1995

[30] Foreign Application Priority Data

| | | | |
|---|---|---|---|
| Sep. 2, 1994 | [JP] | Japan | 6-210220 |
| Sep. 2, 1994 | [JP] | Japan | 6-210248 |
| Jul. 31, 1995 | [JP] | Japan | 6-195606 |

[51] Int. Cl.[6] ..... B41J 2/205

[52] U.S. Cl. ..... 347/19; 347/101; 358/504

[58] Field of Search ..... 347/19, 43, 101, 347/21, 23; 358/504

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,538,160 | 8/1985 | Uchiyama et al. | 347/101 |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,189,521 | 2/1993 | Ohtsuba et al. | 358/296 |
| 5,530,462 | 6/1996 | Takahashi et al. | 347/23 |

FOREIGN PATENT DOCUMENTS

| | | |
|---|---|---|
| 54-056847 | 5/1979 | Japan . |
| 56-084992 | 7/1981 | Japan . |
| 59-123670 | 7/1984 | Japan . |
| 59-138461 | 8/1984 | Japan . |
| 60-071260 | 4/1985 | Japan . |
| 61-261078 | 11/1986 | Japan . |
| 61-261079 | 11/1986 | Japan . |
| 64-063185 | 3/1989 | Japan . |
| 5202328 | 8/1993 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

By ejection from each ejection opening of a liquid ejecting head, predetermined lengths of ruled line patterns are formed in order, and by ejection of an ink from an ink ejecting head, a solid pattern is printed overlaying the ruled line patterns of the liquid. In this case, the portion corresponding to the ejection opening through which the liquid cannot be ejected may be a different printing density in comparison with another portion where the liquid and the ink are overlaid. By this, non-ejection failure at the ejection opening can be detected. Therefore, in an ink-jet printing apparatus employing a head for ejecting the liquid for making a coloring agent in the ink insoluable for enhancing water resistance, the ejection condition of the head can be successfully detected.

29 Claims, 19 Drawing Sheets

INK-JET PRINTING APPARATUS AND METHOD FOR TEST PRINTING USING INK AND AN INK IMPROVING LIQUID

BACKGROUND OF THE INVENTION

1. Field of the Invention

The present invention relates generally to an ink-jet printing apparatus and a test printing method. More specifically, the invention relates to an ink-jet printing apparatus for performing printing by ejecting an ink and a hypochromic or achromatic liquid for making the coloring agent in the ink insoluble or coagulating the coloring agent, on a printing medium, and a test printing method therefor. The present invention is applicable for all devices employing printing media, such as paper, cloth, non-woven fabrics, OHP sheets and so forth. In concrete, the invention is applicable for office equipment, such as a printer, a copying machine, a facsimile machine, mass-production equipment and so forth.

2. Description of Prior Art

Ink-jet printing systems are widely utilized in printers, copy machines and so forth for low noise, low running cost, compact apparatus size, and ease of providing color printing capability.

However, when printing is performed for printing an image on a printing medium, so-called plain paper by the apparatus employing such ink-jet printing system, it is possible to degrade the printed image quality due to lack of water-resistance. Also, upon printing of a color image, in the case that a large amount of ink is ejected for obtaining high density color image, it is possible to cause permeation of the ink into the printing medium to cause feathering. On the other hand, when attempt is made to obtain high density color image with restricting permeation of the ink into the printing medium, bleeding can be caused between adjacent distinct colors. In any of the above-mentioned cases, printing quality in color printing can be significantly degraded.

As a measure for improving water-resistance of the image, it has been practiced in recent years to provide water-resistance for the coloring agent contained in the ink. However, in certain environmental conditions, the water-resistance currently provided for the coloring agent is still insufficient. In addition, in principle, such ink with the water-resistive coloring agent is insoluble to water once it is dried. Therefore, it has high possibility of causing plugging of the printing head. This, in turn, inherently requires complexity of a construction for preventing plugging of the printing head.

As another measure for improving water-resistance, Japanese Laid-Open Patent Application No. 84992/1981 discloses a method to preliminarily coat a material for fixing the coloring agent on the printing paper. That is, it is taught that a large number of specific printing papers each of which is coated with the material for fixing, are previously prepared. However, in this method, it becomes necessary to prepare a specific printing paper. Also, it is unavoidable to cause enlarging in size and cost of an apparatus for preliminarily coating the material for fixing the coloring agent. Furthermore, it is not easy to stably coat the coloring agent fixing material on the printing paper at a predetermined coat layer thickness.

Japanese Laid-Open Patent Application No. 63185/1989 discloses a technology for fixing an achromatic and transparent liquid which makes the coloring agent contained in the ink insoluble, on the printing paper by means of a liquid-jet head. Also, Japanese Laid-Open Patent Application No. 202328/1993 discloses a technology for obtaining a color image without causing color bleeding by employing an ink containing a chemical dye including carboxyl group and polymetal salt solution and by applying the ink after application of the polymetal salt solution to obtain water-resistance.

When the achromatic and transparent liquid for making the dye insoluble is ejected through the liquid-jet head, it is clearly necessary to check whether such achromatic and transparent liquid is normally ejected through all of the ejection openings of the liquid-jet head or not, similarly to that required in normal printing ink. However, a construction to certainly detect ejecting condition of the liquid-jet head for ejecting such liquid has not been available, at the present. Therefore, the only measure currently available is to apply the construction for detecting ejection failure of the printing head for ejecting normal printing ink. Hereinafter, discussion will be given for ejection failure to be caused in the printing head for ejecting ink, a recovery process for the ejection failure-and the conventional construction for detecting the ejection failure.

In the printing operation of an on-demand type ink-jet printing system, all of a plurality of ejection openings provided on one printing head are not always used throughout printing operation. Frequently, non-use ejection openings which are not used for a given period or longer, are present in the ejection head. Also, when a plurality of printing heads are present, such as in a color printing apparatus, it is possible that no printing data is transferred to a certain printing head (ejection is not performed therethrough). In such case, the overall printing head may be placed in non-use condition. In such case, since a cap is held released during printing operation, the ink located in the vicinity of or within the ejection openings which are held in non-use state for a certain period, is inherently dried to cause lowering of ink ejection performance or to cause failure of ejection in the worst case, and thus causes degradation of the printed image quality.

The ejection failure may also be caused by adhesion of ink mist generated in association with ejection of the ink, or paper dust and so forth in the vicinity of the ejection openings.

Furthermore, among ink-jet printing methods, in a system, in which an ejection head is provided in an ink passage portion communicating with the ejection openings of the ink-jet head for generating thermal energy to be utilized for ejection of the ink, the thermal energy is applied to the ink within the ink passage portion to cause film boiling of the ink to perform ejection of ink utilizing growth of a bubble, small bubbles may be accumulated within the ink passage through repeated growth of the bubble. Accumulation of such bubbles in the ink passage may cause interference with supplying of the ink, and possibly cause ejection failure, in which ejection of ink cannot be performed.

As a measure for preventing such ejection failure, it has been proposed, for example, to perform capping for the printing head during non-printing or resting state to prevent the ink from increasing viscosity or solidifying. It is also typical to perform an ejection recovery process for forced discharge of the ink of the increased viscosity or foreign matter around the ejection opening, which cannot be removed by a wiping blade, by means of a suction pump connected to the cap.

Particularly, in case of the ink-jet printing apparatus employing the ink-jet head having a plurality of ejection openings, ejection failure, non-ejection or offset of ejecting direction should result in significant degradation of the printed image quality. Therefore, it becomes necessary to somehow detect ejecting condition of each ejection opening. Such detecting method may be utilized for checking whether a recovery process is necessary or normal ejection is resumed after the recovery process.

Conventionally, as a method for checking the ejecting condition, a method for detecting ejection failure by measuring temperature increase upon ejection of the ink with a temperature sensor provided in the printing head has been known. This method utilizes a fact that heat accumulation in the head is increased when non-ejection failure is caused and whereby temperature increase becomes large. However, in this method, it is possible that ejection failure cannot be detected even when ejection failure is caused at a few number of ejection openings in the head which has relatively large number of ejection openings, e.g. 50 or 100 ejection openings. Therefore, such method cannot provide precision for enabling judgment whether ejection is performed or not with respect to each individual ejection opening.

Also, there has been known a method for detecting whether the ink ejection failure is caused or not by detecting an ink droplet ejected from each ejection opening with an optical sensor. However, such method inherently causes an increase in cost.

As the simplest method for detection of ejection failure, Japanese Laid-Open Patent Application Nos. 261078/1986 and 261079/1986 disclose methods for performing a predetermined pattern which is prepared for checking ejecting condition of each ejection opening, on the printing medium and for visually making judgment. This method is effective for the colored ink since the printed image is visible. The method surely enables the ejection failure of the ink-jet head ejecting a colored ink to be detected because the ink is visually checked. However, in case of the liquid-jet head ejecting a light colored liquid or an achromatic and transparent liquid, it is difficult to visually check the printed image. Therefore, in this method, ejection failure cannot be detected for the ejection openings ejecting the hypochromic or transparent liquid.

Also, when the ejection failure cannot be detected, it is possible to cause not only degradation of the printed image, but also increasing of consumption of the liquid because of unnecessarily performing the suction recovery operation even when ejection failure is not actually caused.

SUMMARY OF THE INVENTION

It is therefore an object of the present invention to provide an ink-jet printing apparatus which can easily check ejection failure of an liquid-jet head for ejecting a light colored liquid or an achromatic and transparent liquid containing compound for making a coloring agent in an ink insoluble or agglomerating the coloring agent, and thus can provide water-resistance to enable high quality and highly reliable image printing without causing feathering or color bleeding upon color printing, and a testing method for such printing apparatus.

Another object of the invention is to provide an ink-jet printing apparatus which can print a test pattern by printing operation for ejecting an ink and a liquid for making the coloring agent insoluble to the same position on the printing medium, and by printing operation for ejecting only ink, and a testing method for such printing apparatus.

A further object of the present invention is to provide an ink-jet printing apparatus which performs printing with overlaying an ink and a liquid only at the predetermined region, and can enable detection when ejection failure is caused, by differentiating printing density of the overlaid pattern in comparison with the pattern printed under normal ejection, and a test printing method for such apparatus.

In a first aspect of the present invention, there is provided an ink-jet printing apparatus for performing printing on a printing medium employing ink ejecting means for ejecting an ink and liquid ejecting means for ejecting a liquid containing a material for making coloring agent in the ink ejected through the ink ejecting means insoluble or for agglomerating, the apparatus comprising:

means for ejecting the ink and the liquid from the ink ejecting means for ejecting the ink and the liquid ejecting means for ejecting the liquid, respectively, so as to print a test pattern, in which the ink and the liquid are overlaid with each other at a predetermined pixel.

In a second aspect of the present invention, there is provided an ink-jet printing apparatus for performing printing on a printing medium employing ink ejecting means for ejecting an ink and liquid ejecting means for ejecting a liquid containing a material for making coloring agent in the ink ejected through the ink ejecting means insoluble or for agglomerating, the apparatus comprising:

storage means for storing a test pattern to be printed by using the ink ejecting means for ejecting the ink and the liquid ejecting means for ejecting the liquid; and implementing means for performing printing of the test pattern.

In a third aspect of the present invention, there is provided an ink-jet printing apparatus for performing printing on a printing medium employing ink ejecting means for ejecting an ink and liquid ejecting means for ejecting a liquid containing a material for making coloring agent in the ink ejected through the ink ejecting means insoluble or for agglomerating, the apparatus comprising:

means for ejecting the ink and the liquid from the ink ejecting means for ejecting the ink and the liquid ejecting means for ejecting the liquid so as to print a test pattern, in which the ink and the liquid are overlaid with each other; and detecting means for detecting the test pattern printed by the means.

In a fourth aspect of the present invention, there is provided a test printing method for performing printing on a printing medium employing ejecting means for ejecting an ink and liquid ejecting means for ejecting a liquid containing a material for making coloring agent in the ink ejected through the ink ejecting means insoluble or for agglomerating, the method comprising the step of:

ejecting the ink and the liquid from the ink ejecting means for ejecting the ink and the liquid ejecting means for ejecting the liquid, respectively, so as to print a test pattern, in which the ink and the liquid are overlaid with each other at a predetermined pixel.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF PREFERRED EMBODIMENTS

The preferred embodiments of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessarily obscure the present invention.

Figure 1:
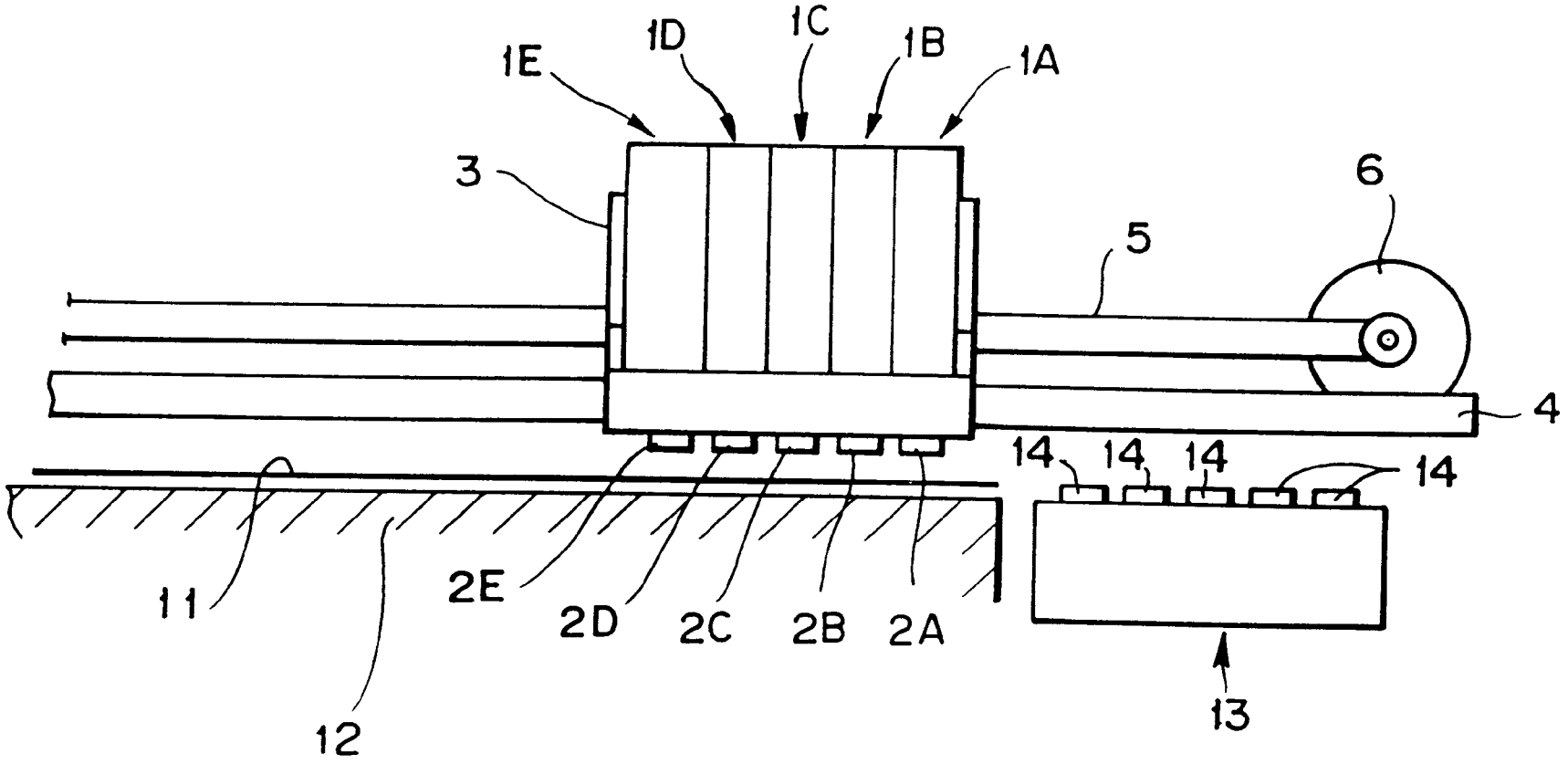
FIG. 1 is a general front elevation showing a major part of the first embodiment of a printing apparatus according to the present invention.
Figure 2:
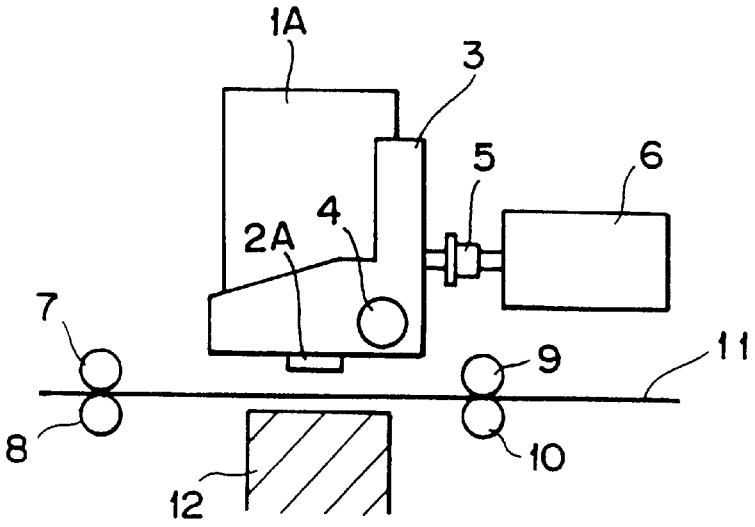
FIG. 2 is a general side elevation of a major part of the printing apparatus of FIG. 1.

FIG. 1 is a general front elevation of a printing apparatus according to the present invention, and FIG. 2 is a general side elevation of the printing apparatus. In these figures, reference numerals 1A to 1D denote ink-jet cartridges, respectively having ink tank portions at upper portions, printing heads 2A to 2D as ink ejecting portions at lower portions, and connectors (not shown) for receiving signals for driving the printing heads 2A to 2D. In the ink tanks of the ink-jet cartridges 1A to 1D, yellow, magenta, cyan and black inks are stored. The reference numeral 1E denotes a cartridge for a liquid, which cartridge is constructed to have the same construction as the ink-jet cartridges 1A to 1D. However, within the tank of the cartridge 1E, the liquid which makes the coloring agent in the various inks ejected from the printing heads 2A to 2D insoluble is stored. Hereinafter, the ink-jet cartridges 1A to 1D and the cartridge 1E for the liquid may occasionally be referred to simply as "cartridges 1A to 1E." Also, the printing heads 2A to 2D and a head 2E as a liquid ejecting portion ejecting the liquid may occasionally referred to simply as "printing heads 2A to 2E".

The printing heads 2A to 2E have electrothermal transducers generating film boiling in the respective inks and the liquid. Namely, for each of the printing heads 2A to 2E, a plurality of ejection openings are arranged in a predetermined direction in a form of an array. When the head is installed in the printing apparatus, each ejection opening array is oriented along a feeding direction (left and right direction in FIG. 2) of a paper 11 as a printing medium. For each of a plurality of ejection openings, the above-mentioned electrothermal transducer is provided. By this, the ink and the liquid may be ejected through the ejection openings.

A reference numeral 3 denotes a carriage, on which the cartridges 1A to 1E are positioned and mounted. The carriage 3 is provided with a connector holder (not shown) transmitting signals for driving the printing heads 2A to 2E of the cartridges 1A to 1E. A reference numeral 4 denotes a guide shaft extending in a primary scanning direction of the carriage 3 for slidingly supporting the same. A reference numeral 5 denotes a drive belt for transmitting a drive force for reciprocally moving the carriage 3. A reference numeral 6 denotes a carriage drive motor. Reference numerals 7, 8 and 9, 10 denote feeding roller pairs for holding therebetween and feeding the paper 11. The feeding roller pairs 7,8 and 9, 10 are located at the upstream side and downstream side of a printing position where printing by respective printing heads is performed, in the feeding direction, respectively. The paper 11 is depressed onto a platen 12 for maintaining flatness of the printing surface. The printing heads 2A to 2E are positioned between the feeding rollers 7 and 9 with placing a surface where the ejection openings are formed in parallel to the printing surface of the paper depressed onto the platen 12, as shown in FIG. 2.

In case of the shown embodiment of the ink-jet printing apparatus, a recovery system unit 13 is provided at a home position side position, i.e., the right side of FIG. 1. In the recovery system unit 13, a reference numeral 14 denotes cap units provided corresponding to the printing heads 2A to 2E. The cap units 14 are movable in up and down directions in FIG. 1. The cap units 14 cap respective printing heads 2A to 2E when the carriage 3 is maintained at the home position to prevent drying in the ejection openings of the printing heads 2A to 2E. On the other hand, in the recovery unit 13, a pump unit (not shown) is provided to perform an ejection recovery process by a command entry of the operator or at a predetermined timing. In the ejection recovery process, the pump unit is used for generating a negative pressure within the cap units 14 capped on respective printing heads 2A to 2E for suctioning the ink within the ejection openings.

Figure 3:
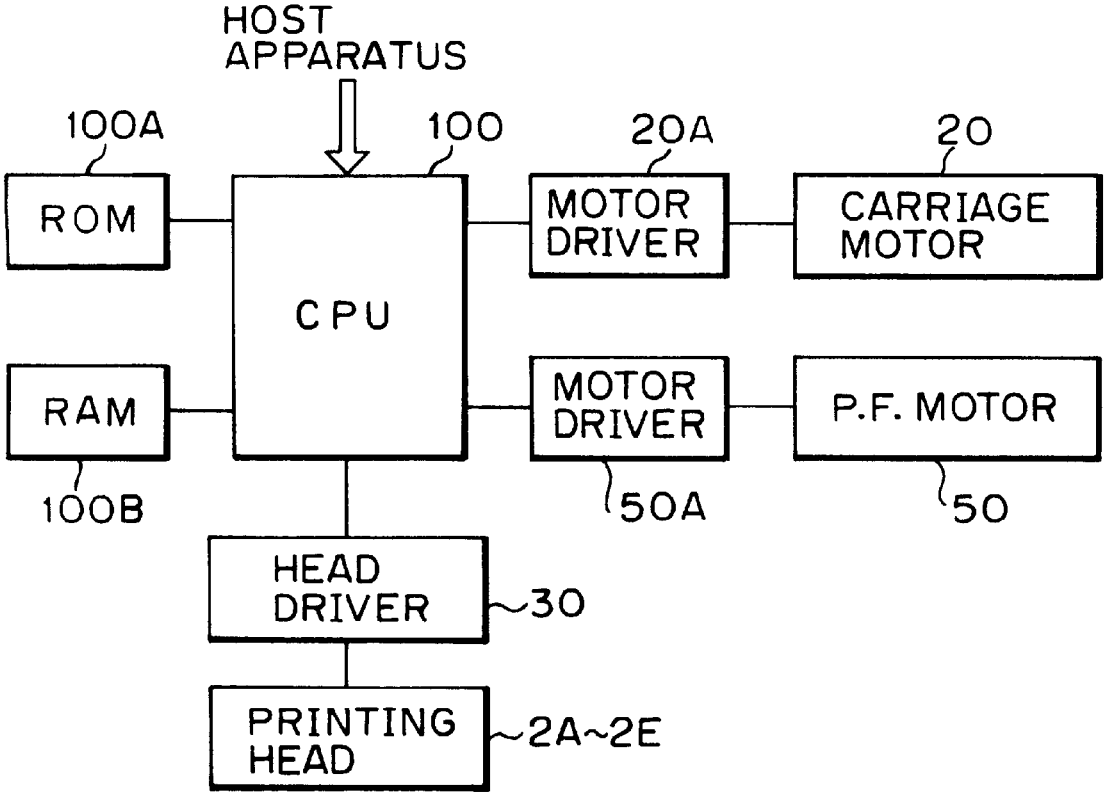
FIG. 3 is a block diagram showing a major part of a control system in the printing apparatus shown in FIGS. 1 and 2.

FIG. 3 is a block diagram showing a control system of the ink-jet printing apparatus.

In FIG. 3, CPU 100 executes a control process for respective portions of the apparatus and data processing. In ROM 100A, the processing procedure to be executed by the CPU 100 is stored. On the other hand, RAM 100B is used as a work area for executing the processing. Ejection of the ink or the liquid by the printing heads 2A to 2E is performed by supplying driving data for the above-mentioned electro-thermal transducers and drive control signals to the head driver 30 by the CPU 100, for example. Also, CPU 100 controls the motor 6 for moving the carriage 3 and a feed motor (P. F. motor) 50 for driving the feed rollers 7, 8, 9 and 10 to rotate via motor drivers 20A and 50A. On the other hand, the CPU 100 controls printing of a predetermined test pattern by performing test printing by the printing heads 2A to 2E, as discussed later.

Figure 4:
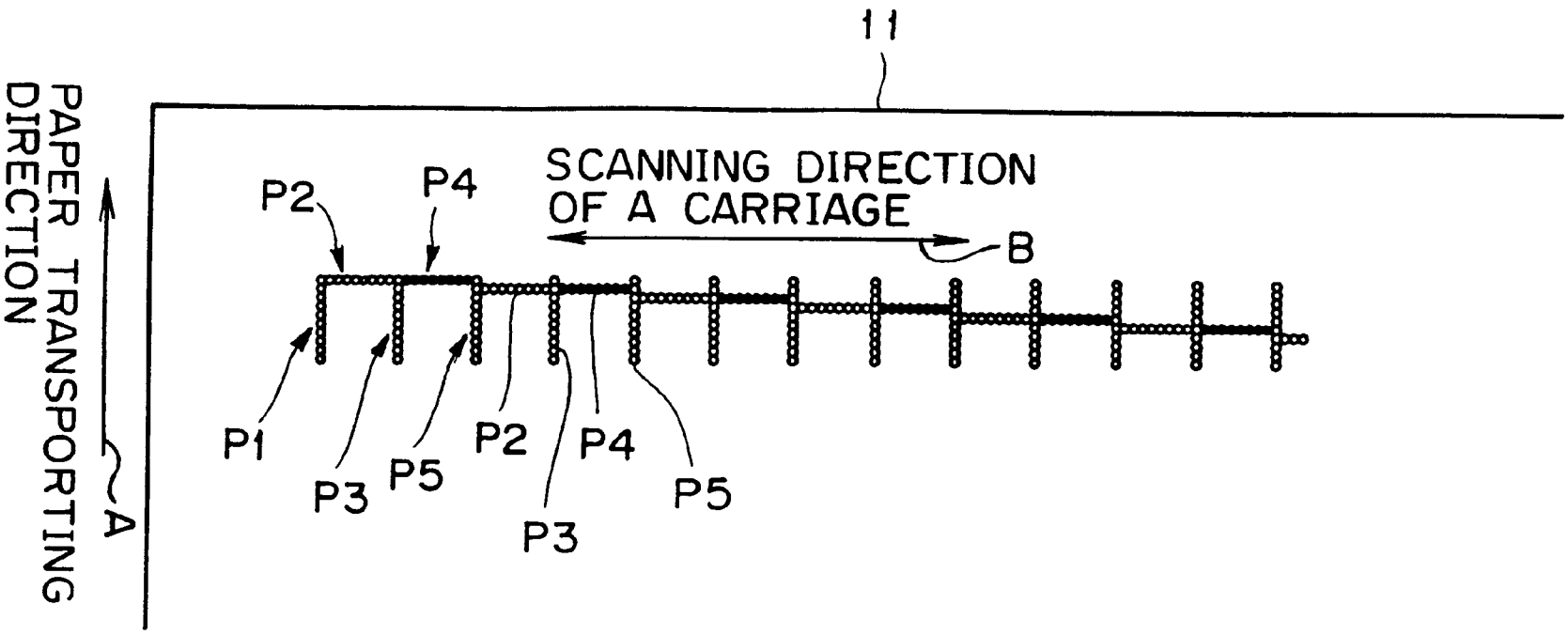
FIG. 4 is an explanatory illustration showing one example of a result of test printing by a first embodiment of the printing apparatus according to the invention.
Figure 5:
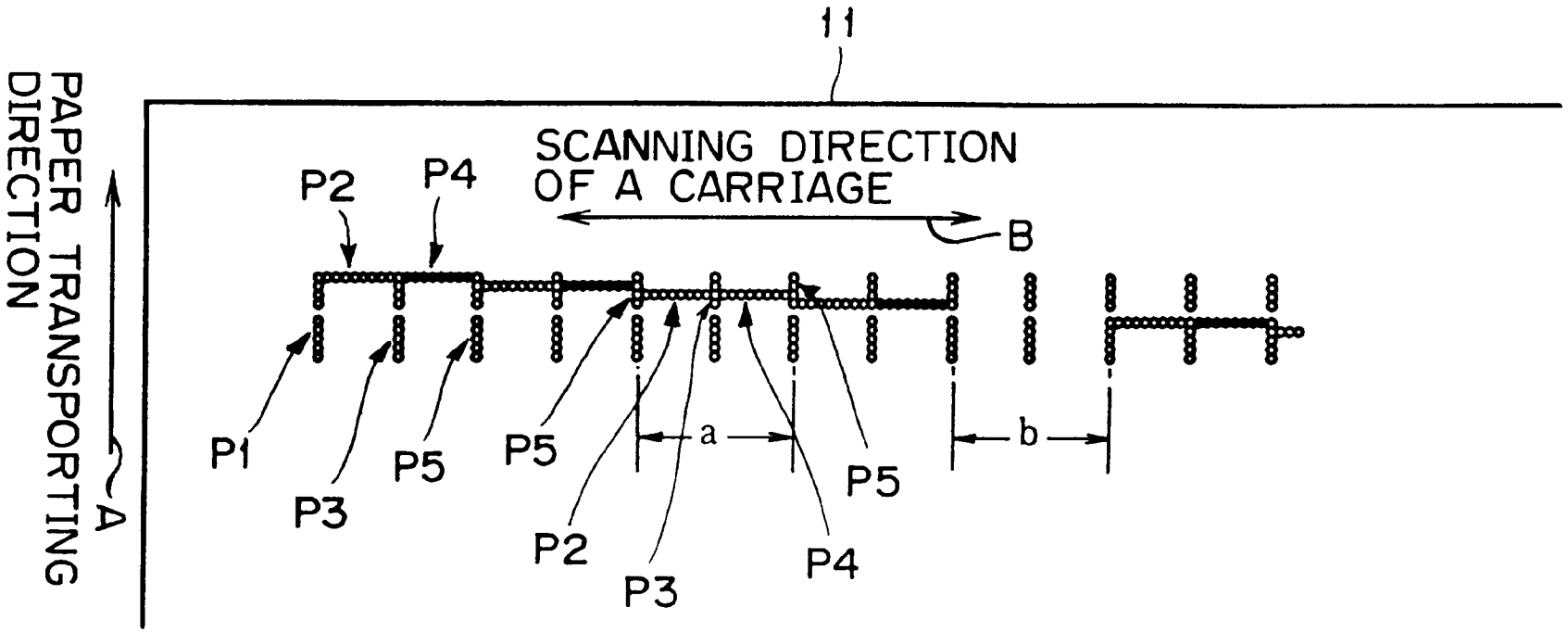
FIG. 5 is an explanatory illustration showing another example of the result of test printing by the first embodiment of the printing apparatus according to the invention.

FIGS. 4 and 5 are explanatory illustrations for explaining test printing by the shown embodiment. FIG. 4 shows test printing by the one of the printing heads 2A to 2D and the head 2E for ejecting the liquid, in which is shown the result of test printing when respective ejection openings of respective heads are normal. In FIG. 4, an arrow A represents a feeding direction of the paper 11, and an arrow B represents a scanning direction of the carriage 3. In FIG. 4, a test pattern of one unit is formed with straight lines P1 to P5(P1). As set forth above, the pattern is formed by one of the printing heads 2A to 2D and the head 2E for the liquid. Of course, the patterns are formed by means of one of the other printing heads and the head 2E.

P1 is the straight line as the first pattern to be formed by all of the ejection openings of a testing head, which is one of the printing heads 2A to 2D (hereinafter, it is assumed as the printing head 2A for simplification of disclosure). In case of FIG. 4, by normally ejecting ink through all of the ejection openings of the printing head 2A, the straight line P1 is formed with no drop out portion. P2 is a straight line as a second pattern formed by ejecting ink through one of the ejection openings of the head 2A. The ejection opening for printing the straight line P2 is shifted to lower one opening in one-by-one basis every time of formation of the fifth straight line P5 which will be discussed later. P3 is a straight line as the third pattern formed similarly to the straight line P1.

P4 is a straight line as the fourth pattern formed by ejecting the ink through one ejection opening of the head 2A and ejecting the liquid through the ejection opening of the printing head 2E corresponding to the ejection opening ejecting the ink. The ejection openings for ejecting ink and the liquid for forming this pattern are shifted to lower one opening in one-by-one basis every time of formation of the fifth straight line P5 which will be discussed later. Here, difference between the straight lines P2 and P4 is that in the former case, the ink is not made insoluble since the liquid is not ejected, whereas in the later case, the ink is made insoluble by the liquid ejected to the same position. The difference between these patterns, i.e. the second and fourth patterns P2 and P4 can be noticeable as a difference of color taste. Also, when a moisture is deposited in the vicinity of each of two patterns, the former may cause bleeding and the latter may not cause bleeding. Therefore, by presence and absence of bleeding, difference in the patterns P2 and P4 can be appreciated. As a means for depositing moisture, an ink-jet system utilizing water in place of the ink may be used. P5 is a straight pattern as the fifth pattern formed similarly to the straight line P1.

Once printing of the straight lines P1 to P5 for one unit is performed, the ejection openings in the head 2A and the head 2E for ejecting the ink and the liquid for forming the straight lines P2 and P4 for the next one unit of test pattern printing are shifted to lower one opening in one-by-one basis. By repeating the foregoing operation, the patterns P2 and P4 are formed by ejection of the ink and the liquid through all of the ejection openings of the heads 2A and 2E to complete test printing.

As shown in FIG. 4, in the normal state where no ejection failure of the ink and the liquid is caused, no drop out portion will be created in the straight lines P1 to P5, a check can be performed of the difference of the color taste or of bleeding condition upon depositing moisture of the straight lines P2 and P4 located at both sides of the straight line P3.

FIG. 5 shows the result of test printing in the case where the upper fifth ejection opening of the printing head 2A causes ejection failure and the upper third ejection opening of the printing head 2E causes ejection failure. Namely, on the test pattern forming range a by the third ejection openings of the printing heads 2A and 2E, the ejection failure of the liquid through the upper third ejection opening of the head 2E can be detected by no difference of the color tastes between the straight lines P2 and P4, or by presence of bleeding on the line P4 upon deposition of the moisture. Thus, even when the liquid is a light colored one or achromatic and transparent one, the ejection opening in the faulty condition for not ejecting the liquid can be identified. Also, in the test pattern formation range where the test pattern is formed by the upper fifth ejection openings of the head 2A and the head 2E, at least the non-ejecting failure in the upper fifth ejection opening of the head 2A can be detected by absence of visible lines P2 and P4.

It should be noted that, by selecting the printing heads 2A to 2D in order as the testing head, test printing can be performed with respect to all ejection openings of all printing heads.

Here, discussion will be given for composition of the liquid and the ink. It should be noted that, in the following discussion, the liquid L may be referred to simply as liquid and the printing ink may be referred to simply as ink.

It is possible to obtain one example of achromatic and transparent liquid as follows.

That is, first of all, the following ingredients are mixed. Then the mixture is filtrated through a membrane filter of 0.22 $\mu$m in pore size (trade name: Floropore filter, Sumitomo Denko Co., LTD.). A filtrate solution is adjusted to pH 4.8 by adding NaOH to obtain the liquid A1.

Composition of A1

| | |
|---|---|
| a low molecular ingredient of a cationic compound stearyl trimethyl ammonium chloride (trade name: Electro-stopper QE, manufactured by Kao Co., LTD.) | 2.0 parts by weight |
| a high molecular ingredient of a cationic compound polyamine sulfone (average molecular weight: 5,000) (trade name: PAS-92, manufactured by Nitto Boseki, Co., LTD.) | 3.0 parts by weight |
| thiodiglycol | 10 parts by weight |
| water | remains |

Also, the ink rendered insoluble by mixing with the above liquid is preferably prepared by the following steps and contains the following ingredients. That is, yellow ink Y1, magenta ink M1, cyan ink C1, and black ink K1 are obtained, respectively, by the process comprising the steps of: mixing the following ingredients and filtrating the mixture through a membrane filter (trade name: Floropore filter, Sumitomo Denko, Co., LTD) of 0.22 mm in pore size under pressure.

Y1

| | |
|---|---|
| C.I Direct yellow 142 | 2 parts by weight |
| Thiodiglycol | 10 parts by weight |
| Acetylenol EH (Kawaken fine-chemical, Co., LTD.) | 0.05 parts by weight |
| Water | remains |

M1

M1 is prepared from the same ingredients except that 2.5 parts by weight of acid red 289 is used as a dyestuff instead of C.I Direct yellow 142.

C1

C1 is prepared from the same ingredients except that 2.5 parts by weight of acid blue 9 is used as the dyestuff instead of C.I Direct yellow 142.

K1

K1 is prepared from the same ingredients except that 3 parts by weight of hood black 2 is used as the dyestuff instead of C.I Direct yellow 142.

The liquid and the ink, both having one of the above compositions (aqueous compositions), are mixed with each other at a certain inner or surface position of the recording medium as a result of their permeation therethrough. In the mixture, as a first stage of the reaction, the low molecular ingredient or the cationic oligomer of the cationic substance is associated with the anionic compound used in a pigment ink or with a water-soluble dye having an anionic group used in an ink. The moment they associate, a phase separation occurs and results in an aggregation of the pigments or dyestuff by means of a dispersion-breakdown caused in the ink or the pigment ink.

As a second stage of the reaction, an aggregate of the dyestuff or the pigments generated as a result of the above association becomes larger by adsorbing the aggregate on the surface of the high molecular ingredient being included in the liquid. Consequently, it becomes difficult to introduce the aggregate into the space formed among fibers of the printing medium, while an aqueous part of the mixture without a solid part is able to permeate through the printing medium. Accordingly, the high printing quality and the stable fixation can be consistent with each other.

Furthermore, the above aggregate becomes highly viscous, so that the aggregate cannot pass through the printing medium in company with the aqueous medium. Regardless of arranging the different color-ink dots so as to be adjacent to each other, as in the case of a multiple-color image formation, there is no mixing and bleeding between these different ink dots. In this case, furthermore, a light-fastness of the image can be also improved by forming the image with a screening effect of the polymer.

By the way, the term "insoluble" or "aggregation" means the observable events in only the above first step or in both the first and second steps.

For carrying out the present invention, furthermore, there is no need to use a high-molecular cationic substance and a polyvalent metal salt. Alternatively, the amount of using these substances can be kept at the minimum when there is need to use them. Because they are only used as secondary substances for further improving effects of the present invention. As a result, we are able to give another effect of the present invention in that the present invention enables to prevent a lowering of coloring properties of the dyestuff. The lower coloring properties of the dyestuff are a problem caused by using the high-molecular cationic substance and the polyvalent metal salt for obtaining an effect of water-resistance in the conventional method.

The printing medium to be used for carrying out the present invention is not limited to a specific medium. It can be preferably selected from any kinds of normal paper, such as copy paper, bond paper, and so on, which have been used in the conventional printing process. It is noted that coated paper prepared especially for ink-jet printing and transparent paper for an overhead projector can be also applied as the printing medium of the present invention. Furthermore, general wood-free paper and glossy paper are preferably used in the present invention.

For embodiments of the present invention, the employed ink is not limited to especially the dyestuff ink, but also it is possible to use the ink comprising dispersed pigments. In the latter case, the liquid can be an agglutination of the pigment. The following are examples of the pigment ink that causes an agglutination by mixing with the above-mentioned liquid A. That is, as will be described, each color ink of yellow Y2, magenta M2, cyan C2, and black K2 is prepared in the form comprising a pigment and an anionic compound.

Black ink K2

An anionic high-molecule P-1 (stylene-methacrylic acide-ethylacrylate, an acidic value 400, an average molecular weight 6,000, an aqueous solution containing 20% solid material, and a potassium hydroxide as a liquid neutralizing agent) is used as a dispersion agent. The following materials are filled in a vertical batch-type sand mill (manufactured by Imex Co., LTD) and then glass beads of 1 mm in diameter are provided as media to fill the hole tightly. After that, the mixture is subjected to a water-cooled dispersion treatment for three hours, resulting in a fluid dispersion having the viscosity of 9 cps and the pH of 10.0. The obtained fluid dispersion is centrifuged by a centrifuge to separate contained materials of different specific gravities to remove coarse particles. Consequently, a dispersion body of carbon-black with an average particle diameter of 100 nm results.

Composition of the carbon-black dispersion body

| | |
|---|---|
| P-1 aqueous solution (including 20% of solidified portion) | 40 parts by weight |
| Carbon black Mogul L (Cablack made) | 24 parts by weight |
| Glycerin | 15 parts by weight |
| Ethyleneglycol monobutyl ether | 0.5 parts by weight |
| Isopropyl alcohol | 3 parts by weight |
| Water | 135 parts by weight |

A black ink K2 for the ink-jet printing, comprising pigments as sufficiently-dispersed bodies obtained by the above procedure, is thus prepared. A solidified portion of the final preparation is about 10%.

Yellow ink Y2

An anionic high-molecular substance P-2 (stylene-acryl acid-methylmetaacrylate, an aqueous solution having an acid value of 280, a molecular weight of 11,000, and a solid content of 20%, and neutralizer:diethanolamine) is used as a dispersion agent. The dispersion is managed similarly to the process of preparing the black ink K2 by means of the following materials. Consequently, a yellow color dispersion body of 103 nm in average particle diameter is obtained.

Composition of the yellow dispersion body

| | |
|---|---|
| P - 2 aqueous solution (20% of solid content) | 35 parts by weight |
| C.I. Pigment yellow 180 (Trade name: Nova parm yellow - PH-G, manufactured by Hexist Co., LTD.) | 24 parts by weight |
| Triethylene glycol | 10 parts by weight |
| Diethylene glycol | 10 parts by weight |
| Ethyleneglycol monobutylether | 1.0 parts by weight |
| Isopropyl alcohol | 0.5 parts by weight |
| Water | 135 parts by weight |

A yellow ink Y2 for the ink-jet recording, comprising pigments as sufficiently-dispersed bodies obtained by the above procedure, is thus prepared. A solidified portion of the final preparation is about 10%.

Cyan ink C2

The anionic high-molecular substance P-1, which is used in the preparation of the black ink K2, is also used as a dispersion agent for preparing the cyan ink Y2. The dispersion treatment is managed similarly to the process of preparing the carbon-black dispersion by means of the following materials. Consequently, a cyan color dispersion body of 120 nm in average particle diameter is obtained.

Composition of the cyan dispersion body

| | |
|---|---|
| P - 1 aqueous solution (20% of solid content) | 30 parts by weight |
| C.I. Pigment blue 15:3 (Trade name: Fastgenbul-FGF, manufactured by Dai Nippon Ink Chemicals, Co., LTD.) | 24 parts by weight |
| Triethylene glycol | 10 parts by weight |
| Glycerin | 15 parts by weight |
| Diethyleneglycol monobutylether | 15 parts by weight |
| Isopropyl alcohol | 3 parts by weight |
| Water | 135 parts by weight |

A cyan ink C2 for the ink-jet recording, comprising pigments as sufficiently-dispersed bodies obtained by the above procedure, is thus prepared. A solidified portion of the final preparation is about 9.6%.

Magenta ink M2

The anionic high-molecular substance P-1, which is used in the preparation of the black ink K2, is also used as a dispersion agent for preparing the magenta ink M2. The dispersion treatment is managed similarly to the process of preparing the carbon-black dispersion by means of the following materials. Consequently, a magenta color dispersion body of 115 nm in average particle diameter is obtained.

A composition of the magenta dispersion body

| | |
|---|---|
| P - 1 aqueous solution (20% of solid content) | 24 parts by weight |
| C.I. Pigment red 122 (manufactured by Dai Nippon Ink Chemicals, Co., LTD.) | 24 parts by weight |
| Glycerin | 15 parts by weight |
| Isopropyl alcohol | 3 parts by weight |
| Water | 135 parts by weight |

A magenta ink M2 for the ink-jet recording, comprising pigments as sufficiently-dispersed bodies obtained by the above procedure, is thus prepared. A solidified portion of the final preparation is about 9.2%

It should be noted that, in the shown embodiment, the liquid for making the dye or pigment (which may also be referred to generally as "coloring agent") of respective yellow (Y), magenta (M), cyan (C) and black (K) inks insoluble, has been discussed with taking an example different from respective inks. However, the application of the present invention is not specified to the shown example. For example, a liquid which does not make the coloring agent of yellow ink insoluble but does makes another coloring agent, such as the coloring agent of the black ink, insoluble may be contained in the yellow ink. By this, bleeding at a boundary between the printing regions of the black ink and the yellow ink can be effectively prevented. Also, water-resistance of the black ink can be improved. Also, by containing the liquid which makes the coloring agent of the black ink insoluble in the cyan ink, and overlaying the black ink and the cyan ink, enhancement of back highlighting and improvement of water-resistance can be achieved.

A first modification of the first embodiment

Figure 6:
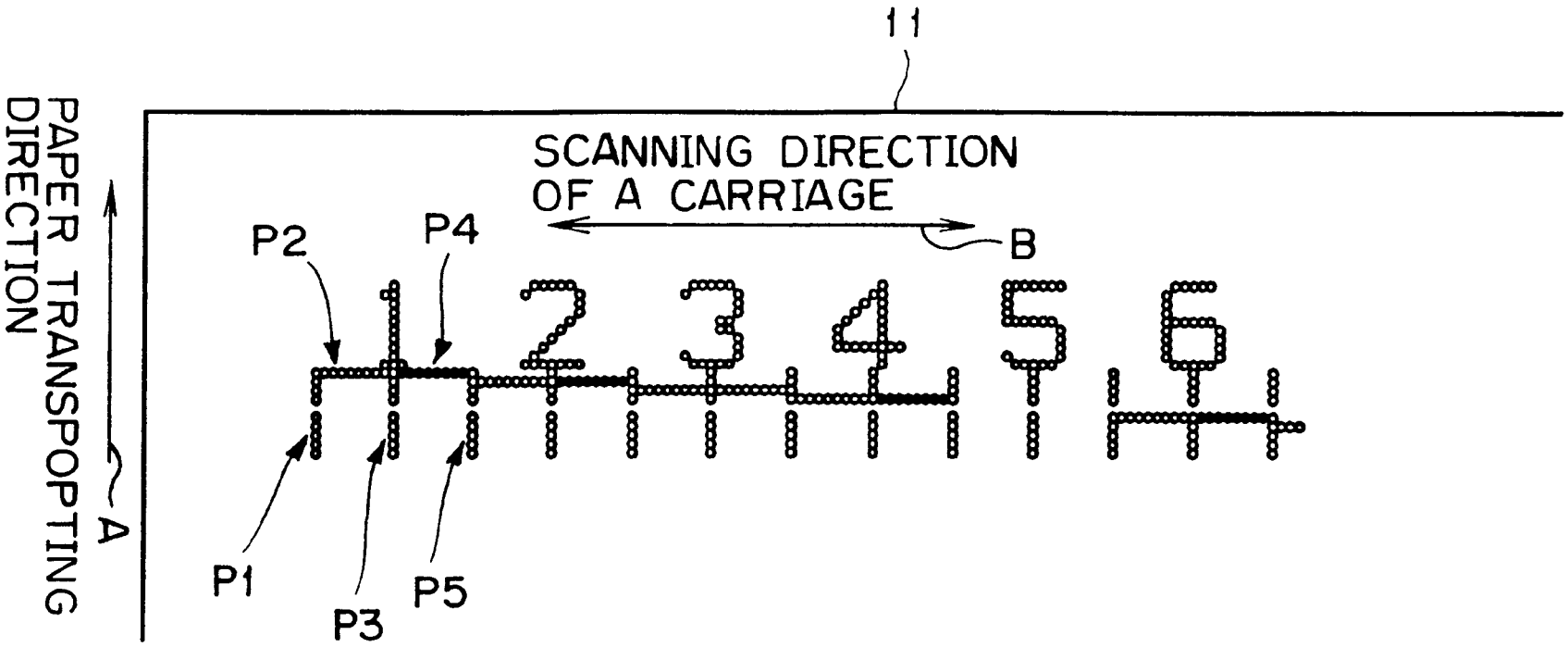
FIG. 6 is an explanatory illustration showing a result of test printing by a modification of the first embodiment of the printing apparatus according to the invention.

FIG. 6 is for explanation of the result of test printing by a modification of the first embodiment of the invention as set forth above.

In the shown embodiment, in advance of implementation of the test printing in the foregoing first embodiment, a number corresponding to the ejection opening is printed in the vicinity of the straight line P3. Therefore, by the printed number, the position of the ejection opening in non-ejection failure condition can be easily identified. In case of the modified embodiment of FIG. 6, the upper third ejection opening of the head 2E for ejecting the liquid in the state of non-ejection failure, and the upper fifth ejection opening of the head 2A is in the state of non-ejection failure, similarly to the foregoing first embodiment.

A second modification of the first embodiment

FIGS. 7 to 10 are illustrations for explaining a second modification of the first embodiment.

Figure 7:
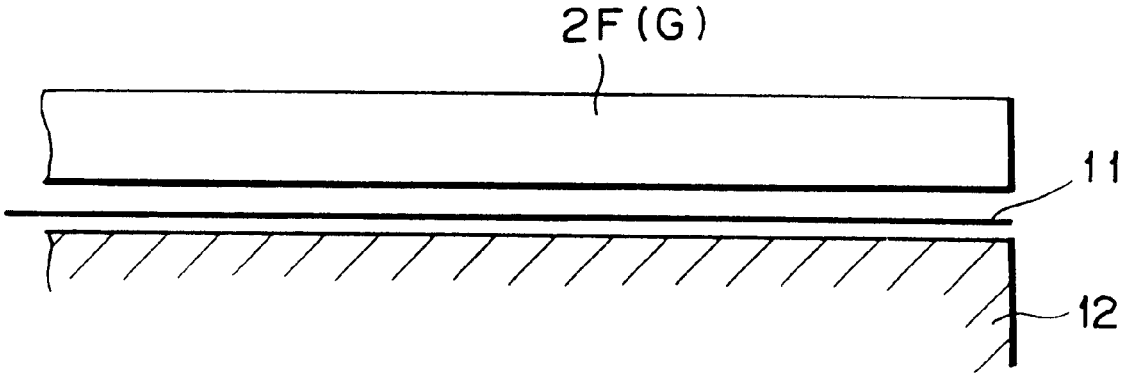
FIG. 7 is an explanatory illustration showing another modification of the first embodiment of the printing apparatus according to the invention.
Figure 8:
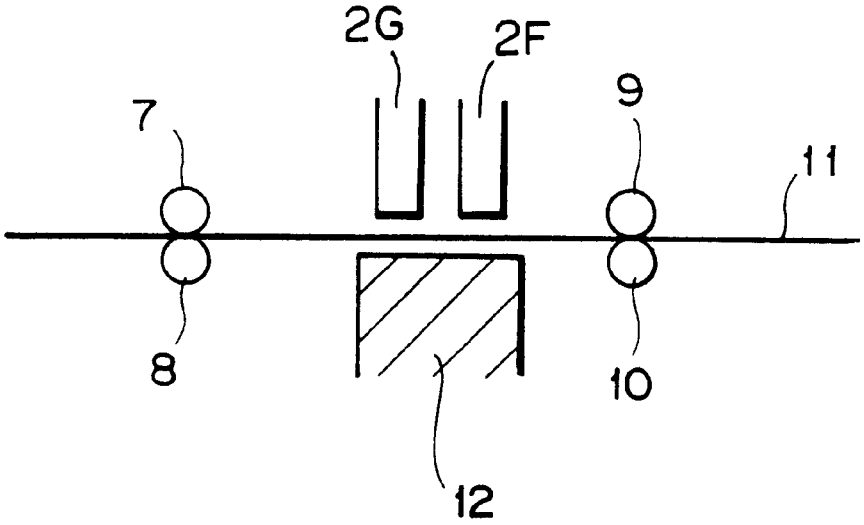
FIG. 8 is a side elevation of the major part of the printing apparatus shown in FIG. 7.

As shown in FIGS. 7 and 8, the shown modified embodiment is directed to the ink-jet printing apparatus, in which, different from the first embodiment and the first modification thereof, full line type printing heads 2F to 2G, in which a plurality of ejection openings are arranged over entire printing regions of the paper 11 in the direction perpendicular to the feeding direction A of the paper 11, are employed in place of the printing heads 2A to 2E of the first embodiment and the modification thereof. In case of the shown embodiment, a capping and recovery unit for protecting the printing heads 2F and 2G is provided within a platen 12 for movement in up and down direction. Other construction is the same as the foregoing first embodiment. It should be noted, however, that in the shown embodiment, information containing the test pattern is printed on the paper 11 by the ejecting operation of the ink and the liquid from the printing heads 2F and 2G and feeding operation of the paper 11.

Figure 9:
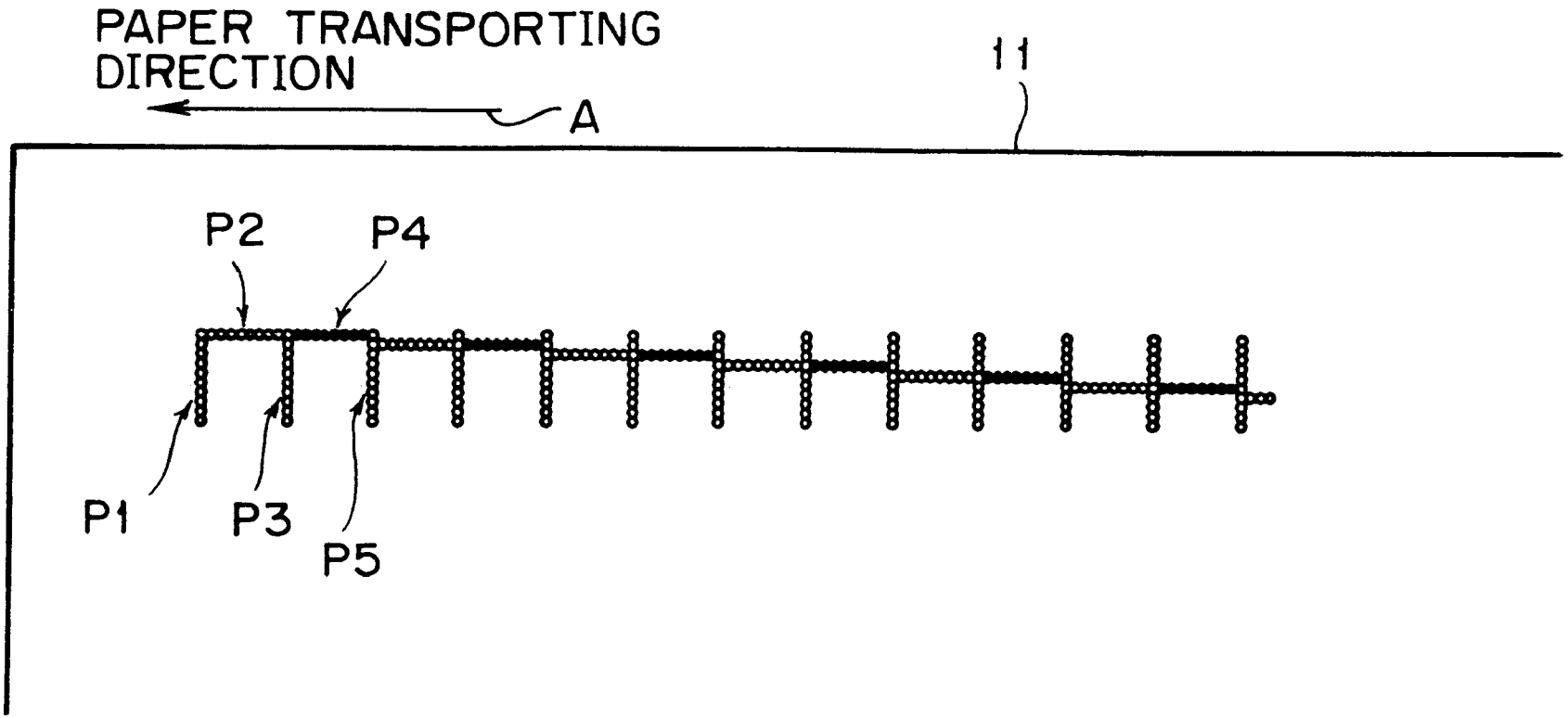
FIG. 9 is an explanatory illustration showing one example of the result of test printing in the printing apparatus shown in FIG. 7.

FIG. 9 shows a result of implementation of the test printing in the case where the heads 2F and 2G operate normally. Similarly to the foregoing first embodiment, the shown embodiment forms the test pattern with the straight lines P1 to P5 as the first to fifth patterns. It should be noted that, in case of the shown embodiment, a plurality of ejection openings of the printing heads 2F and 2G arranged over the entire width of the paper 11 are divided into a plurality of groups of the ejection openings, and the test pattern similar to the foregoing first embodiment can be formed by performing ejection of the ink and the liquid through the ejection openings per each group. Therefore, in FIG. 9, a pattern for test printing of only one group is illustrated.

As shown in FIG. 9, in the normal operating state where no negative ejection of the ink and the liquid is caused, the straight lines P1 to P5 will not have any drop-out portion. Also, in such condition, difference of color tastes between the straight lines P2 and P4 located at both sides of the straight line P3 or presence and absence of bleeding upon deposition of the moisture at respective lines P2 and P4 may be perceptible.

Figure 10:
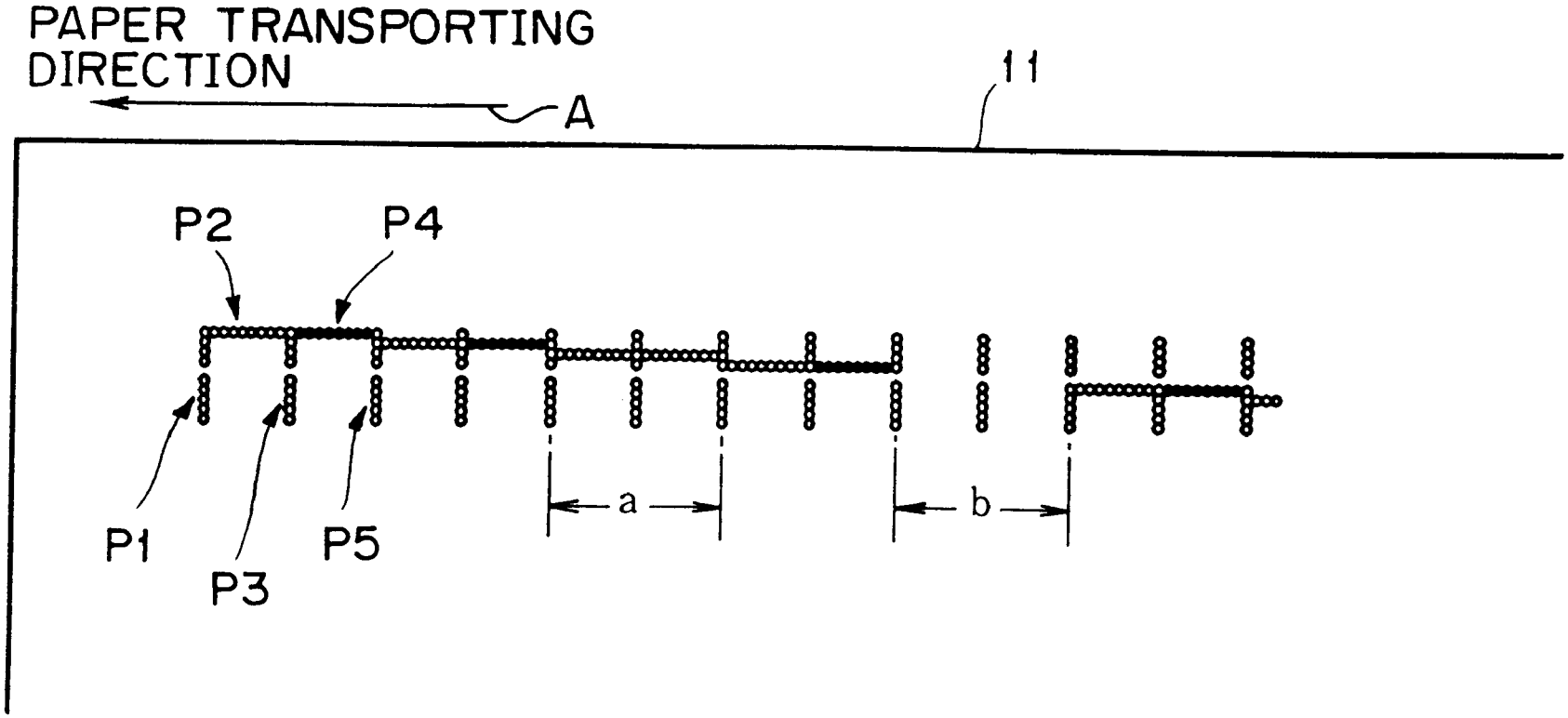
FIG. 10 is an explanatory illustration showing another example of the result of test printing in the printing apparatus shown in FIG. 7.

FIG. 10 shows a result of implementation of the test printing in the case where the upper fifth ejection opening of the head ejecting the ink causes failure of non-ejection and the upper third ejection openings of the head ejecting the liquid also causes failure of non-ejection. In the test pattern formation range a where a test pattern is formed by ejection through the upper third ejection openings of the heads respectively ejecting the ink and the liquid, non-ejection failure of the upper third ejection openings of the head ejecting the liquid can be detected for no difference of color states between the straight lines P2 and P4 or for presence of bleeding on the line P4 upon deposition of the moisture. Accordingly, even when the liquid is an achromatic and transparent one or a light colored one, the ejection opening causing non-ejection failure can be identified. Also, in the test pattern forming range b where a test pattern is formed by ejection through the upper fifth ejection openings of the heads respectively ejecting the ink and the liquid, non-ejection failure of the head ejection ink can be detected by the fact that the lines P2 and P4 are not visually perceptible.

A third modification of the first embodiment

Figure 11:
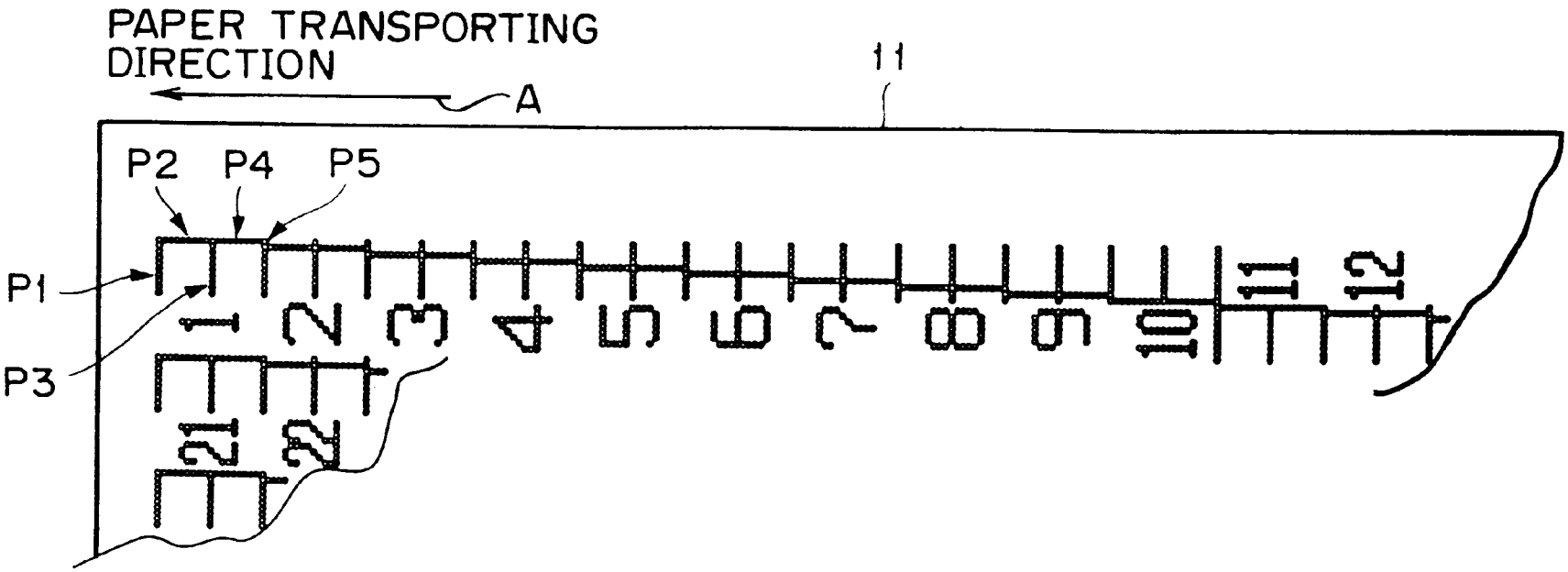
FIG. 11 is an explanatory illustration showing an example of the result of test printing in a still further modification of the first embodiment of the printing apparatus.

FIG. 11 is an illustration for explaining a result of implementation of test printing by a third modification of the first embodiment of the printing apparatus.

In the shown modified embodiment, the same printing apparatus to the second modification set forth above is employed. In the test pattern, at a position in the vicinity of the straight line P3, a number corresponding to the position of the ejection opening in the array of the ejection openings is printed. Accordingly, by the printed number, the ejection opening which cannot eject the ink or the liquid due to failure can be easily identified. It should be noted that, in case of the shown embodiment, a plurality of ejection openings in the printing head 2, which are arranged over the entire width of the printing paper 11, are divided into a plurality of groups containing 20 ejection openings respectively. Then, ink and the liquid are ejected through the ejection openings in respective groups to form the identical test pattern to the second modification. This manner of test printing is particularly effective for the full-line type printing head having relatively large number of ejection openings for capability of inspection of all ejection openings through relatively small feeding amount of the paper 11.

A second embodiment

Figure 12:
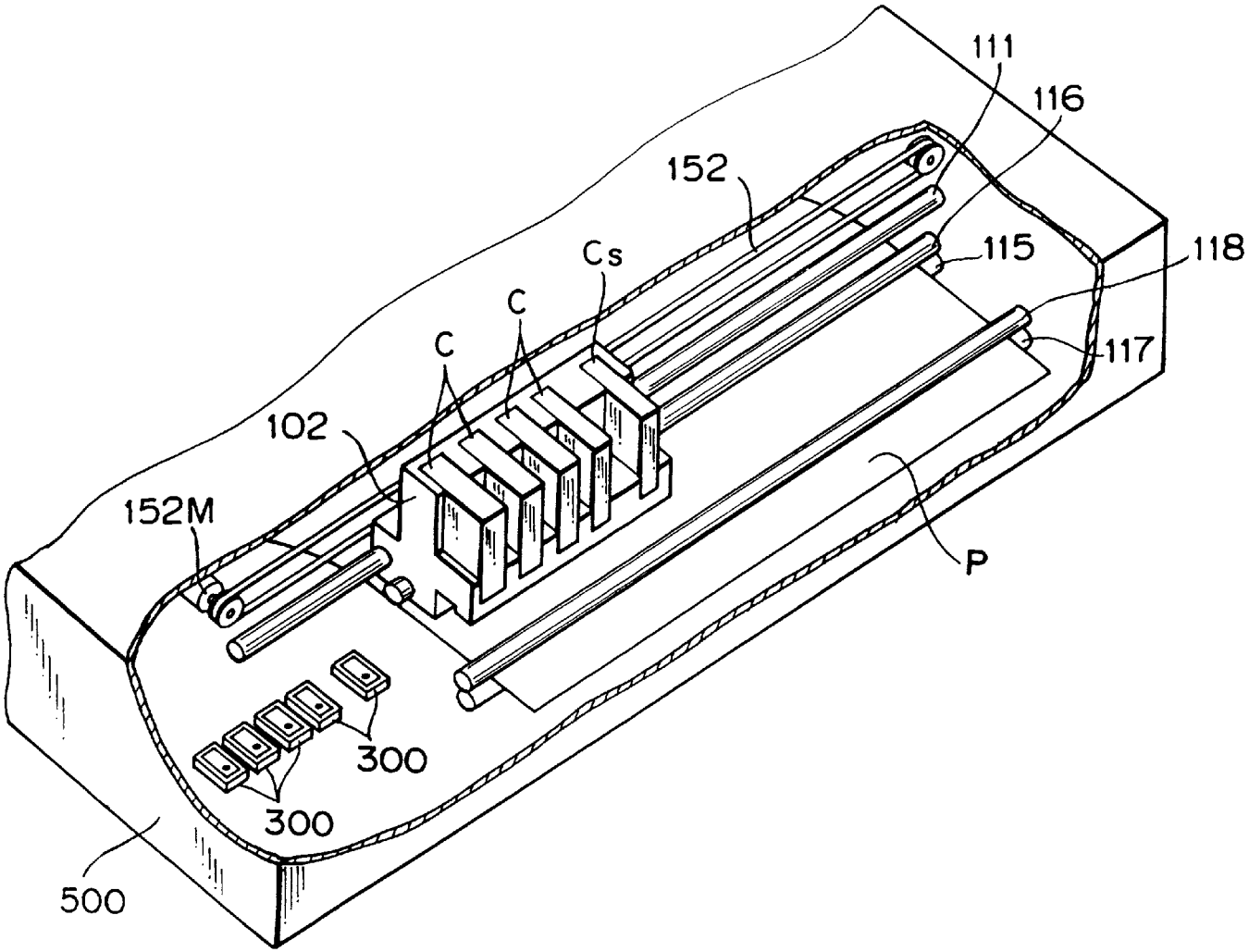
FIG. 12 is a general perspective view showing a second embodiment of an ink-jet printing apparatus according to the present invention.

FIG. 12 is a general perspective view showing a second embodiment of the ink-jet printing apparatus according to the present invention.

In FIG. 12, reference sign C denotes an ink-jet cartridge for ejecting the ink as a printing liquid, which has an ink tank portion at the upper portion and a printing head (not shown) at the lower portion. The ink-jet cartridge C is further provided with a connector for receiving signals for driving the printing head. A reference numeral $C_s$ denotes an ink-jet cartridge having the same construction to the ink-jet cartridge C but adapted for ejecting a liquid, which has a liquid tank and a head for ejecting the liquid. A reference numeral 102 denotes a carriage, on which five cartridges C and $C_s$ (respectively storing different colors of inks and the liquid, i.e., yellow, magenta, cyan and black inks and the liquid which makes the coloring agent of the inks insoluble or causes agglomeration of the coloring agents) are positioned and mounted. Also, the carriage 102 is provided with connector holders for transmitting signals for driving the printing head and the head for ejecting the liquid. Thus, the carriage 102 is electrically connected to respective printing heads C and $C_s$ through the connector holders. In the shown embodiment, the cartridges C of the yellow, magenta, cyan and black inks and the cartridge $C_s$ storing the liquid for making the dyes as the coloring agent insoluble are mounted on the carriage 102 in the listed order from the left side as shown in FIG. 12.

A reference numeral 111 denotes a scanning rail extending in a primary scanning direction of the carriage and slidingly supporting the carriage 102. A reference numeral 152 denotes a drive belt for transmitting a drive force for reciprocating the carriage 102. Reference numerals 115, 116 and 117, 118 are feed roller pairs for holding therebetween and feeding the printing medium, and a reference sign P denotes a printing medium, such as a paper. The printing medium P is depressed onto a platen (not shown) which restricts the printing medium to maintain flatness at the printing surface. Here, the printing heads and the liquid ejecting head of the cartridges C and $C_s$ mounted on the carriage 102 are projected downwardly from the carriage 101 and located between the printing medium feeding rollers 116 and 118. The ejection openings forming faces of the printing heads and the liquid ejection head are oriented to be parallel to the printing medium P depressed on the guide plane of the platen (not shown).

In the shown embodiment of the ink-jet printing apparatus, a recovery unit is located at the home position side at the left side of FIG. 12. In the recovery unit, a reference numeral 300 denotes cap units provided corresponding to respective ones of the printing heads and the liquid ejection head of the cartridges C and $C_s$. The cap units 300 are movable in up and down direction. When the carriage 102 is placed at the home position, the cap units 300 contact with respectively corresponding printing heads and the liquid ejection head for capping the respective heads to prevent the ink and the liquid from evaporating to cause increasing of viscosity or solidification to cause non-ejection failure. The cap unit 300 is communicated with a not shown pump unit to introduce a negative pressure therein during a suction recovery process which is performed with contacting the cap units to the printing head and the liquid ejection head. Also, while the construction is not illustrated in the shown embodiment, the recovery unit may be provided with a wiping blade of a rubber or other elastic material for wiping off a liquid drop depositing on the ejection opening forming faces of the printing head and the liquid ejection head.

In the ink-jet printing apparatus, the liquid which makes the coloring agents of respective color inks insoluble in a water-base solvent or agglomerates the coloring agent in the solvent, is ejected to the printing medium through the liquid ejection head to contact with the inks on the printing medium to provide water-resistance for the printed image. On the printing medium, the coloring agents in the inks react with the liquid to instantly become insoluble or agglomerate, so that water-resistance is not only enhanced but also bleeding is prevented at the boundary of the adjacent different colors. In the shown embodiment, an aqueous solution containing a cation type polymer is used as the liquid and generally employed inks containing acid dye are used as the printing inks.

The achromatic and transparent liquid for making the ink dye insoluble is the same liquid to that employed in the first embodiment and the modifications thereof.

Figure 13:
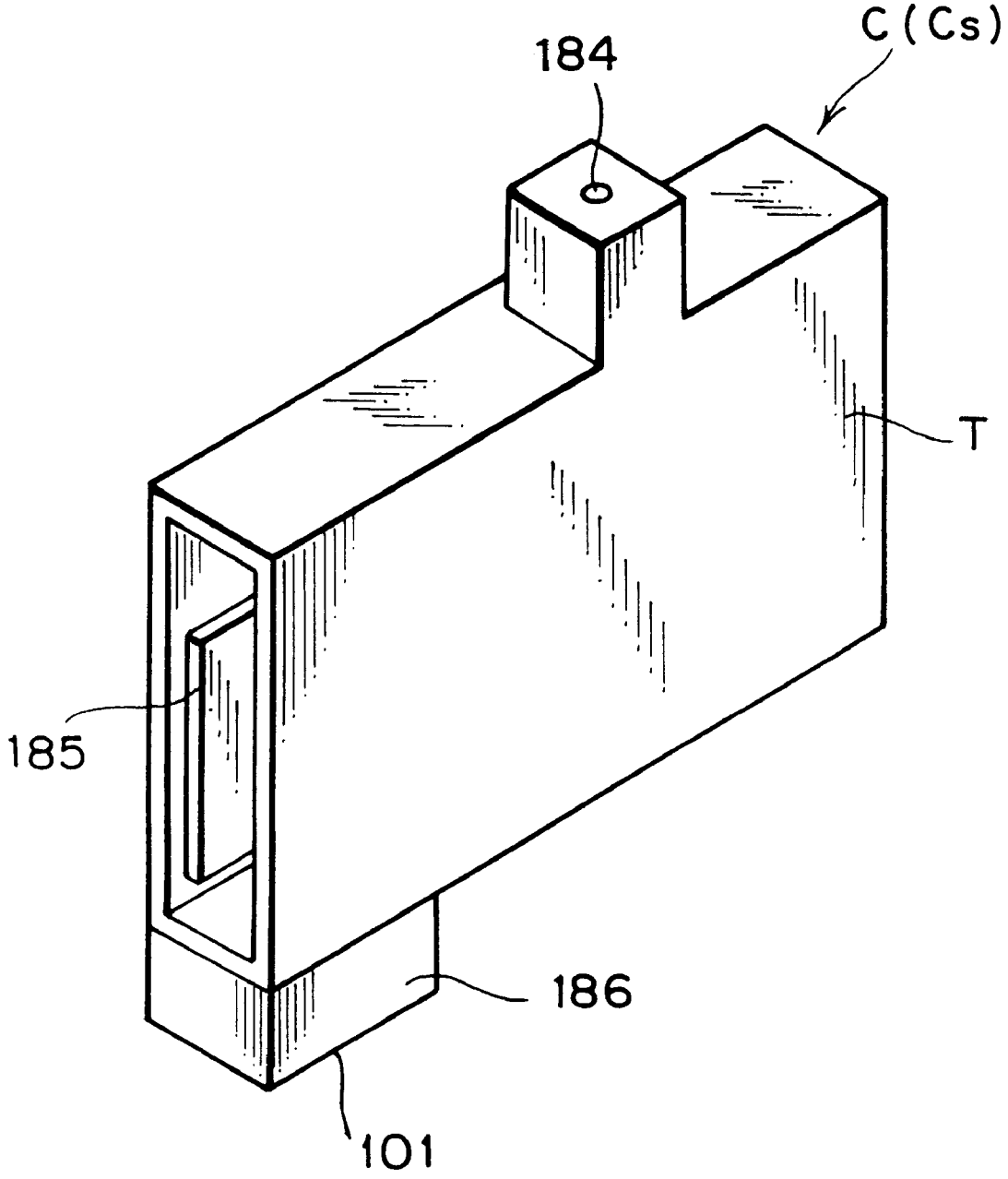
FIG. 13 is a perspective view of an ink-jet cartridge to be employed in the ink-jet printing apparatus.

FIG. 13 is a diagrammatic illustration showing the ink-jet cartridge C or $C_s$, in which the printing head or the liquid ejection head is integrated with the ink tank or the liquid tank, respectively. The shown ink-jet cartridge C or $C_s$ has the ink tank portion or the liquid tank portion T at the upper portion and the printing head portion or the liquid ejection head portion 186 at the lower portion. Also, the ink-jet cartridge is provided with a head side connector 185 for receiving signals for driving the printing head portion or the liquid ejection portion and outputting an output of a remaining ink amount detection and so forth. The printing head portion or so forth 186 has an ejection opening face 101 having a plurality of ejection openings opening to the bottom surface side in the drawing. In each of liquid passage portions communicated with the ejection opening, a heating element (electrothermal transducer element) for generating a thermal energy to be utilized for ejection of ink or the liquid is arranged.

Figure 14:
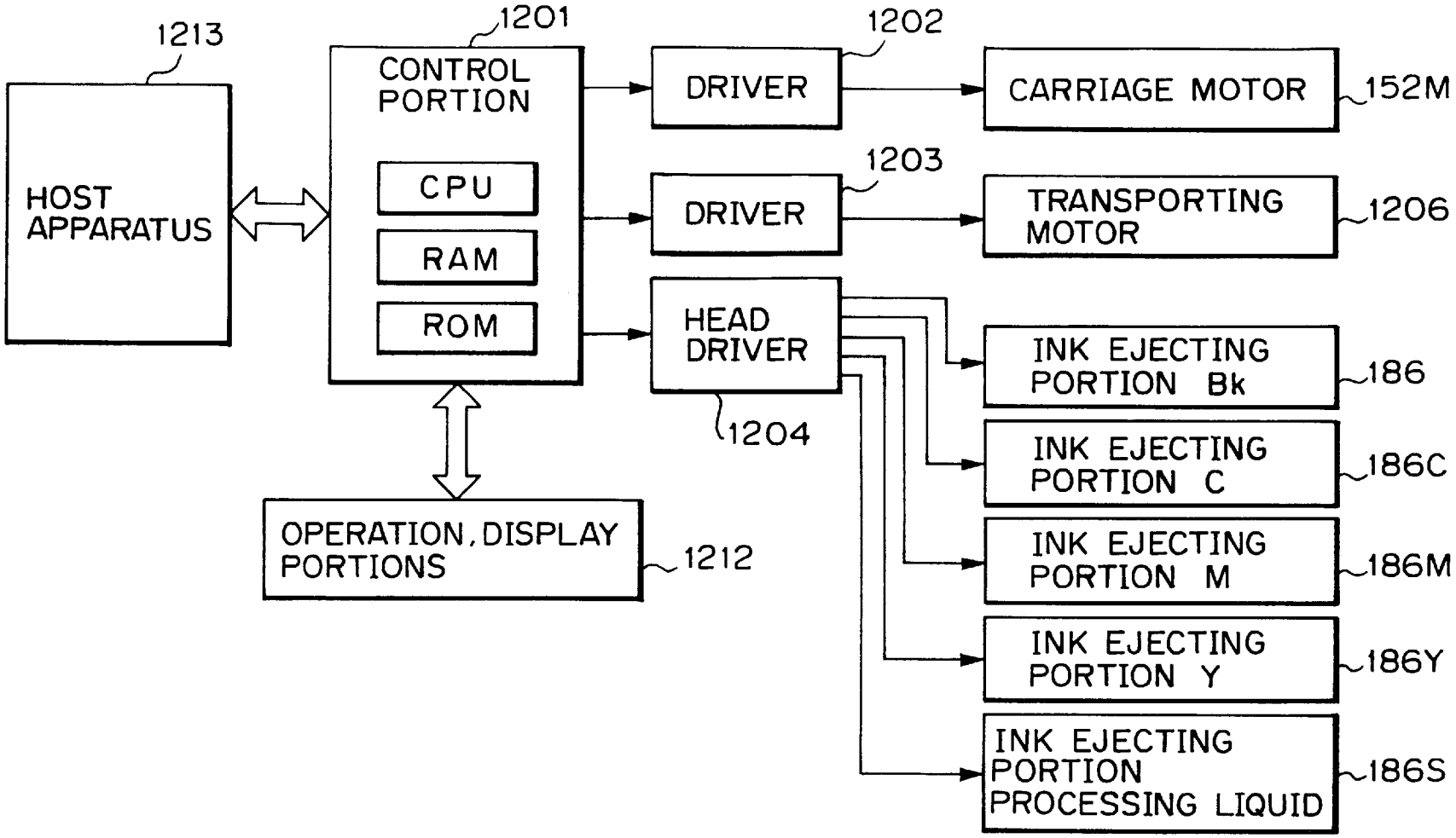
FIG. 14 is a block diagram showing a control system of the second embodiment of the ink-jet printing apparatus.

FIG. 14 is a block diagram showing a control portion of the ink-jet printing apparatus shown in FIG. 12. In FIG. 14, a reference numeral 1201 denotes a control portion mainly constituted of CPU, ROM, RAM and so forth, which control portion performs control for respective portions of the apparatus according to a program stored in the ROM. A reference numeral 1202 denotes a driver for driving a carriage motor 152M for reciprocally driving the carriage 102 on the basis of a signal from the control portion 1201, a reference numeral 1203 denotes a driver for driving a feed motor 1206 for driving the feed rollers 115 to 118 on the basis of a signal from the control portion 1201 and whereby for feeding a printing medium, a reference numeral 1204 denotes a driver for driving respective ink-jet ejecting portions on the basis of a print data from the control portion 1201, a reference numeral 1212 denotes an operation and display portion for performing input of various keys and various displays, and a reference numeral 1213 denotes a host system for supplying printing data to the control portion 1201.

It should be noted that the testing pattern of the shown embodiment, which will be discussed later, is stored in the ROM or so forth in the control portion 1201. Through the operation of the operation and display portion 1212 by the user upon necessity, the test printing mode operation is performed to print the stored test pattern. However, the application of the present invention is not limited to the shown construction. For instance, without storing the test pattern within the ink-jet printing apparatus, printing of the test pattern can be performed by the ink-jet printing apparatus by supplying the test pattern from the host system.

In the shown embodiment of the ink-jet printing apparatus as set forth above, normally, upon performing printing of image data, for all of pixels to which any one of the Y, M, C and Bk (which is also referred as K) ink is ejected, the liquid is ejected. Namely, OR data of the printing data of respective Y, M, C and Bk colors is used as the ejection data for the liquid. By this, since printing is performed in overlaying the liquid dot and the ink dot on the printing medium, ions of an anion type dye and cation type polymer are coupled to make the dye insoluble to water. Thus, water-resistance of the printed image can be enhanced.

In this case, according to the experiments performed by the applicants, when comparison is made for the case where the liquid and the ink are overlaid on the printing medium and the case where only ink is ejected (the liquid is not overlaid), difference in printing density and hue can be observed. Namely, when the liquid and the ink are overlaid, the printing density becomes higher or, alternatively, becomes lower. In certain cases, slight variation of hue can be observed. The shown embodiment effective utilizes such phenomenon similarly to the foregoing first embodiment and the modifications thereof.

Figures 15A, 15B, 15C:
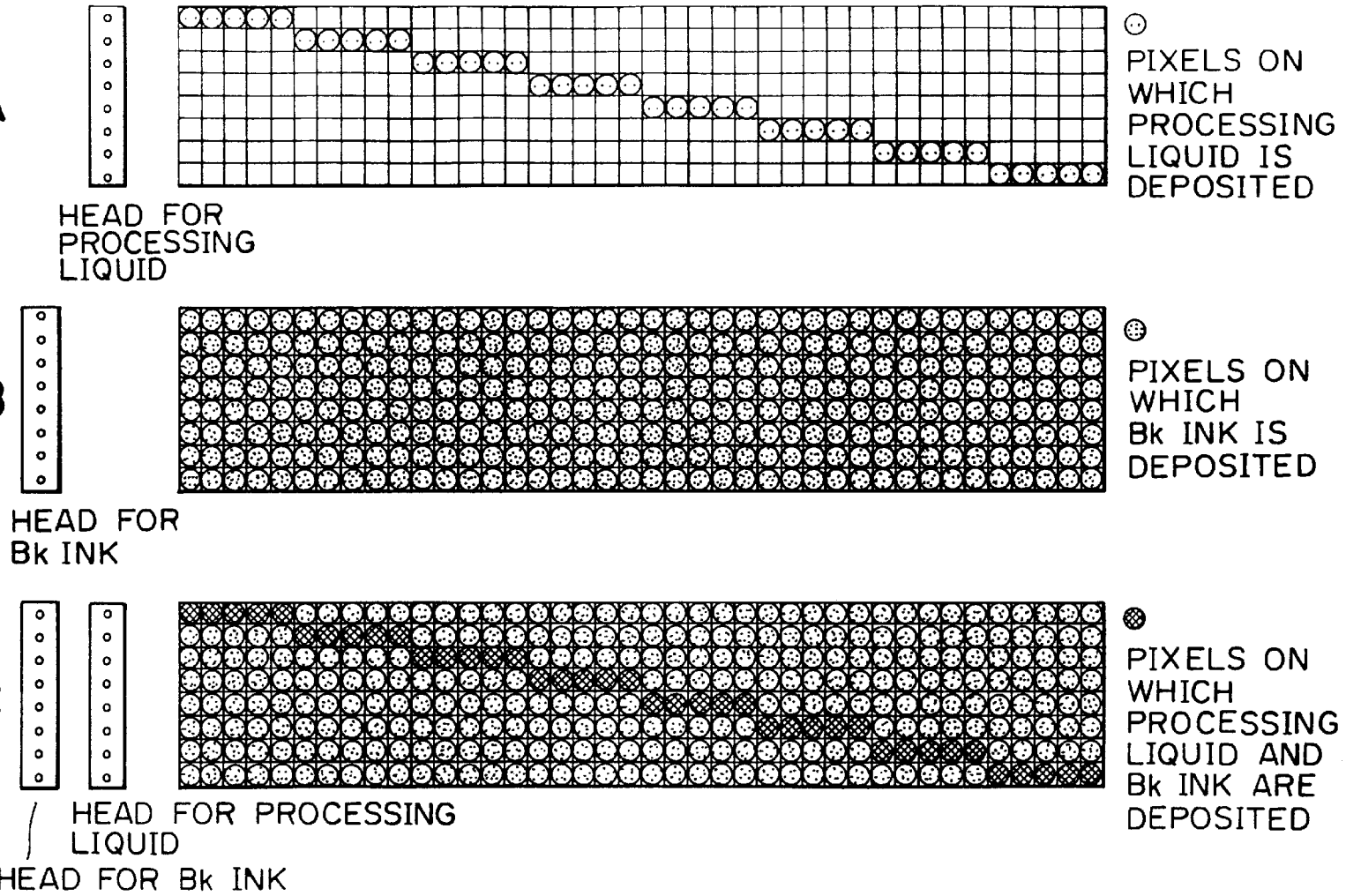
FIGS. 15A to 15C are explanatory illustrations showing patterns of test printing in the second embodiment of the present invention.
Figure 16:
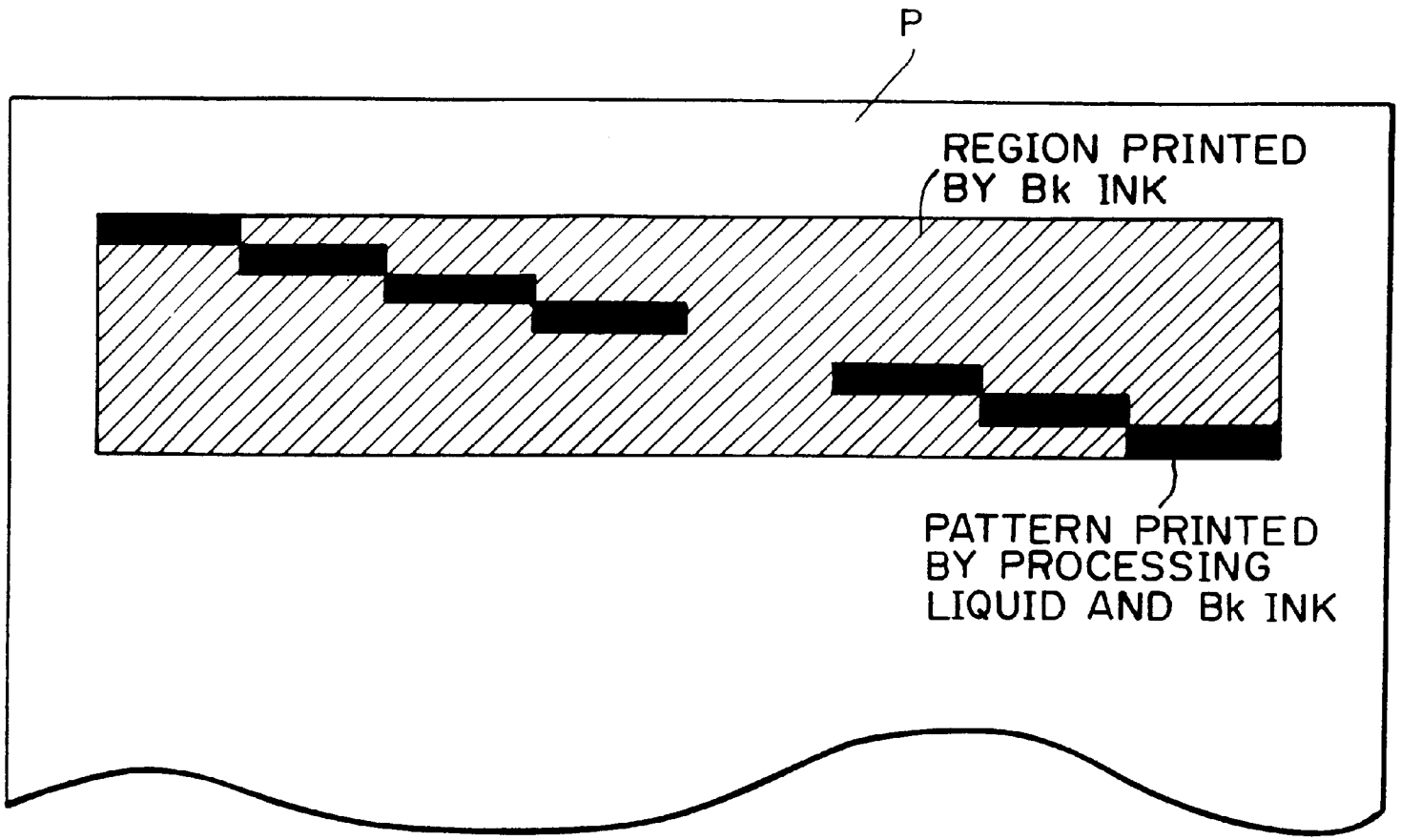
FIG. 16 is a diagrammatic illustration showing a case where the pattern of the test printing of the second embodiment is printed on a printing medium.

FIGS. 15A to 15C and 16 are illustrations for explaining a test printing method for detecting ejecting condition of the liquid ejection head in the shown embodiment. FIGS. 15A to 15C are explanatory illustrations for explaining printing data respectively of the printing head ejecting the Bk ink and the liquid ejection head, in test printing, and FIG. 16 is a diagrammatic illustration showing a result of printing on the printing medium on the basis of the data therefor. Here, for convenience of explanation, discussion will be given for the case where the printing head and the treatment liquid ejection head respectively having 8 ejection openings are employed. However, it is a matter of course that the number of the ejection openings is not limited to the shown example.

As shown in FIG. 15A, the liquid ejection head prints a given length of a ruled line pattern per pixel corresponding to each ejection opening, sequentially in stepwise fashion. On the other hand, the printing head of the Bk ink performs so-called solid printing utilizing all ejection openings, as shown in FIG. 15B. The image data obtained by composing the images of FIGS. 15A and 15B is shown in FIG. 15C. When the image data shown in FIG. 15C is printed on the printing paper, the ink and the liquid are overlaid at the portion where the liquid is ejected to have higher print reflection density only at that portion, as shown in FIG. 16. In certain cases, the hue is slightly varied at the portion where the ink and the liquid are overlaid. Therefore, normal ejecting condition of the liquid can be visually perceptible. For example, in the example of FIG. 16, the condition where non-ejection failure is caused in the upper fifth ejection opening of the liquid ejection head is illustrated.

As to the variation of the density or hue, in comparison with the case where only ink is ejected, when the liquid and the ink are ejected in overlaying manner, the coloring matter in the ink is instantly in contact with the cation compound in the liquid to form greater complex on the printing medium. Therefore, distribution of the coloring matter on the printing medium is varied to cause variation of the printing density, or, in the alternative, the mutual reaction or chemical coupling of the coloring matter and the liquid may cause variation of absorption wavelength of the light to cause variation of hue.

In the discussion given hereabove, while the case where Bk ink and the liquid are overlaid is explained, the ink to be overlaid with the liquid is not limited to the Bk ink, but can be C ink or M ink. Also, the printing pattern of the liquid is also not limited in the stepwise fashion.

It should be noted that, upon implementation of the present invention, similarly to the first embodiment and the modifications thereof, the ink to be used is not limited to the dye ink, but can be a pigment ink, in which the pigment is dispersed. The liquid which may agglomerate the pigment may also be used. One example of such liquid has been disclosed with respect to the first embodiment.

In addition, it is possible to read the test pattern employing the conventional detection technology, employing an optical reading sensor, to automatically perform recovery operation when the ejection opening causing non-ejection failure is detected.

A modification of the second embodiment

FIGS. 17A to 17D are explanatory illustrations explaining test printing patterns for detecting the ejecting condition of the liquid ejection head in a modification of the second embodiment.

Figures 17A, 17B, 17C, 17D:
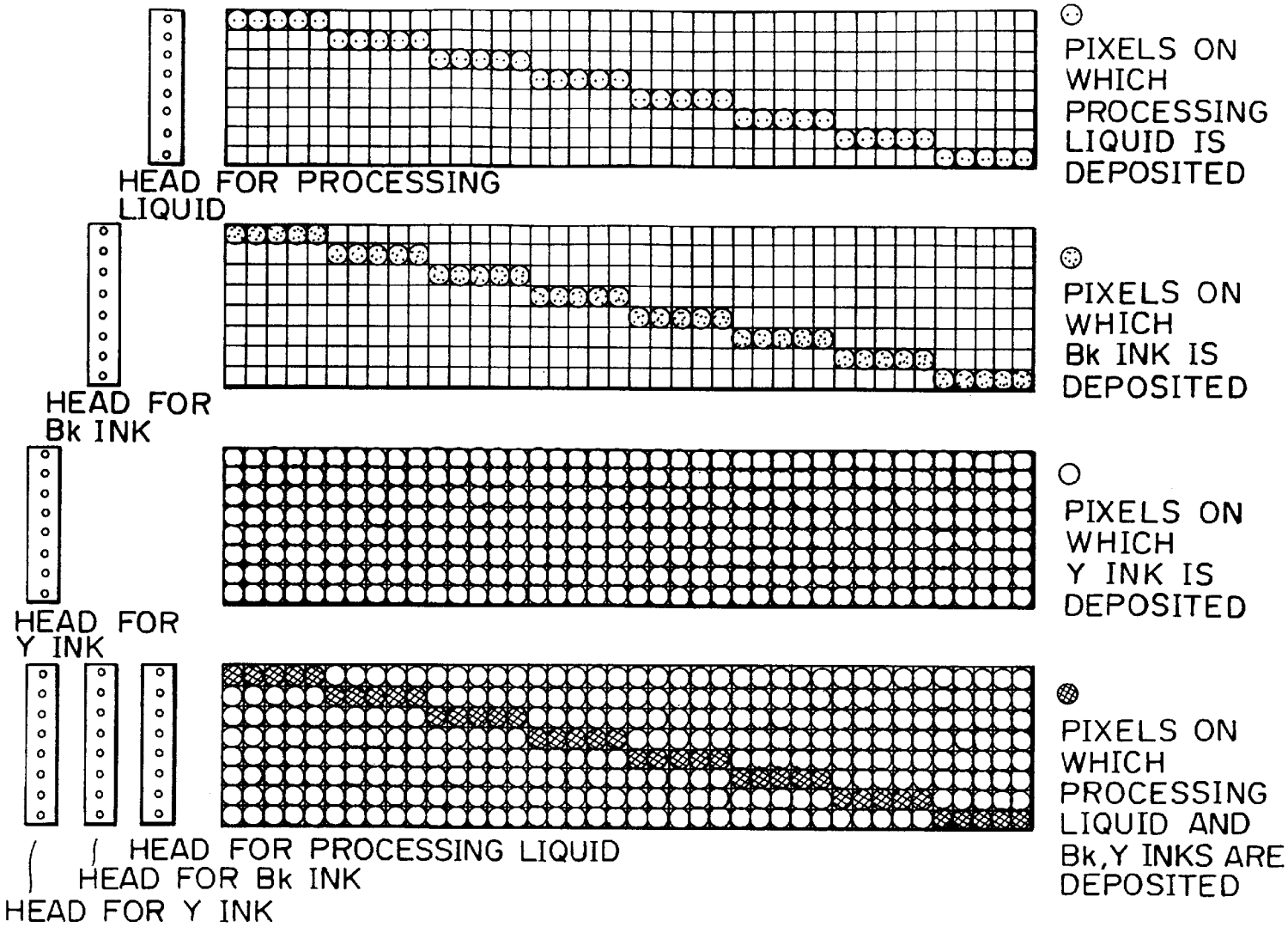
FIGS. 17A to 17D are explanatory illustrations explaining a pattern of the test printing associated with a modification of the second embodiment of the printing apparatus.

Here, the liquid ejection head and the Bk ink printing head performs printing of the ruled line pattern in sequential stepwise fashion by ejection through respective ejection openings, and, in conjunction therewith, the Y ink printing head performs solid printing simultaneously using all of the ejection openings. FIG. 17A shows the printing data for performing printing by the liquid ejection head, FIG. 17B shows printing data for performing printing by the Bk ink printing head. Apparently from FIGS. 17A and 18B, a ruled line pattern of the given length is printed in sequential stepwise fashion per each corresponding ejection opening. Also, the Y ink printing head performs solid printing simultaneously utilizing all of the ejection openings as shown in FIG. 17C. The image data composing these three is shown in FIG. 17D.

Figure 18:
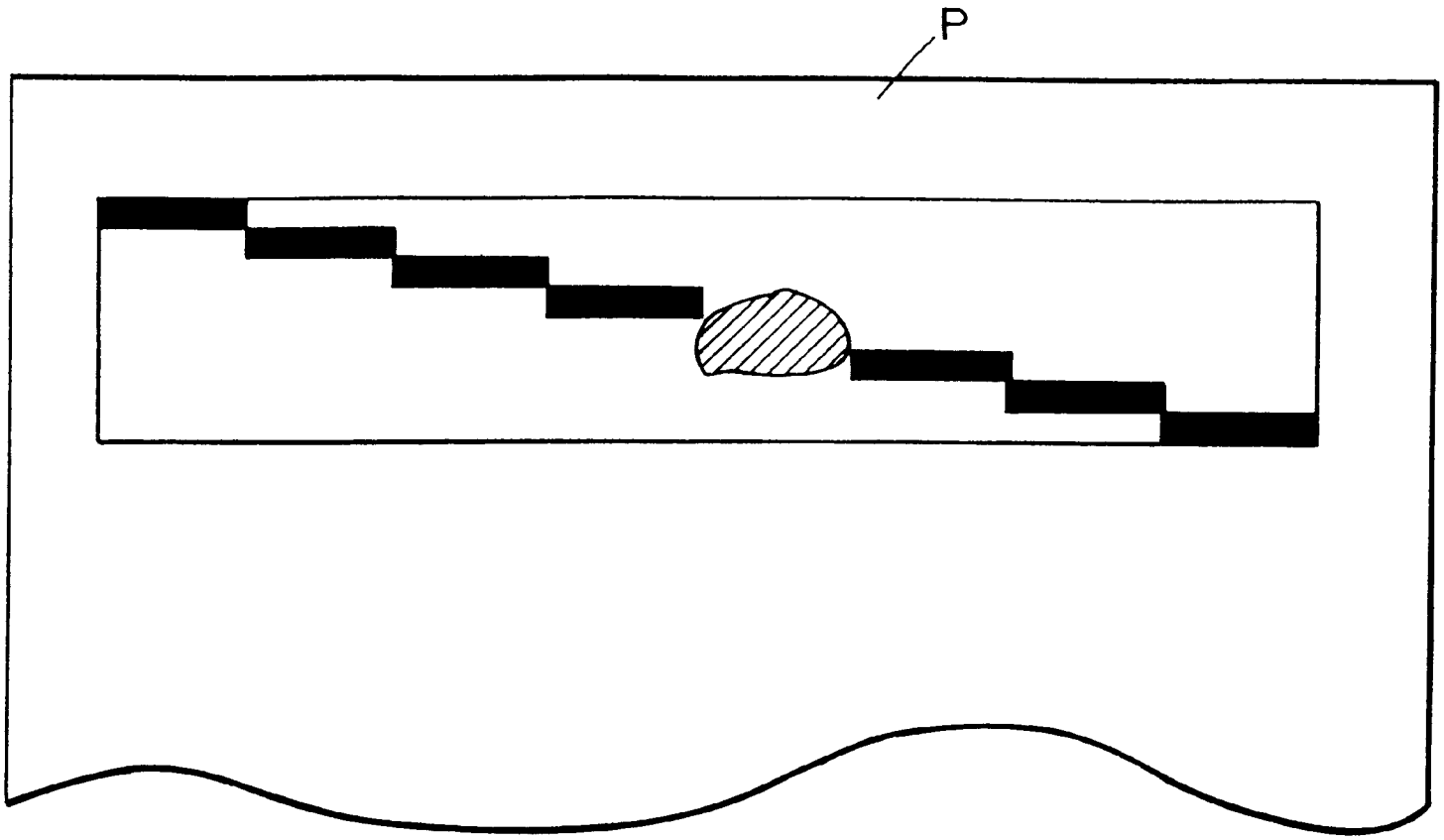
FIG. 18 is a diagrammatic illustration showing a case where the pattern of the test printing in the modified embodiment is printed on a printing medium.

As set forth above, the test printing pattern in the shown embodiment has a pattern, in which three liquid droplets of the liquid, the Bk ink and Y ink are overlaid. When the pattern is printed on the printing paper, the printed image as shown in FIG. 18 is obtained. Namely, FIG. 18 shows the condition where non-ejection failure at the upper fifth ejection opening of the liquid ejection head is caused. At the portion where the liquid is ejected, the coloring agent of the ink is made insoluble. Therefore, even when the Bk ink and Y ink interface, bleeding will never be caused at the boundary thereof. However, at the portion corresponding to the upper fifth ejection opening of the liquid ejection head where the liquid is not ejected, the Bk ink and Y ink contact directly, to penetrate into the ink with dispersion of coloring matters on the printing medium to form an image with poor sharpness. By this, occurrence of non-ejection failure can be detected.

It should be noted that while discussion has been given in terms of an example where the Bk and Y inks are combined, the combination of the colors should not be limited to the shown combination. Also, while the shown example overlays the treatment liquid, the Bk ink and the Y ink, the number of inks and the treatment liquid to be used are not limited to three; a greater number of inks may be overlaid.

On the other hand, while the heads ejecting respective colors of inks and the treatment liquids are formed separately in the first and second embodiments and the modifications thereof, the application of the present invention is not limited to the shown construction. For instance, two or more heads may be constructed integrally. In this sense, the "ejecting portion" means both of the integrally constructed head and separately constructed heads.

It should be noted that, the achromatic and transparent liquid also functions as a printing quality improvement liquid. The improvement of the printing quality is intended to mean improvement of printed image quality, such as density, chroma, sharpness at the edge portion, dot diameter and so forth, improvement of fixing ability of the ink, improvement of image storing ability, such as water-resistance, weather-resistance, such as lightfastness and so forth, and suppression of occurrence of bleeding and blushing. Also, a printing ability enhancing liquid is a liquid contributing to enhancement of the printing ability, which includes a liquid to make the dye in the ink insoluble, a liquid to cause dispersing decomposition of the pigment in the ink and so forth. Here, the word terminology "making insoluble" means a phenomenon to cause mutual ionic reaction between an anion-type group contained in the dye in the ink and a cation type group of cation type substance contained in the printing ability enhancing liquid to cause ion coupling and thus to cause separation of dye which is uniformly dissolved in the ink, from the solution. It should be noted that, in the present invention, even when not all of the dyes of the inks are made insoluble, the effect of suppression of color bleeding, enhancement of color developing ability, enhancement of character quality, and enhancement of fixing ability as intended by the present invention can be obtained. Also, agglomeration is used in the same meaning to making insoluble in the case where the coloring agent employed in the ink is a water base dye containing an anion type group. On the other hand, when the coloring agent employed by the ink is the pigment, the wording "agglomeration" includes to cause mutual ionic reaction between the pigment dispersing agent or the surface of the pigment and the cation type group of the cation type substance contained in the printing ability enhancing liquid to cause dispersing decomposition of the pigment and increasing of granular size of the pigment. Normally, the agglomeration causes increasing of viscosity of the ink. It should be noted, that in the present invention, even when not all of the pigment or the pigment dispersing agent is agglomerated, suppression of color bleeding, enhancement of color developing ability, enhancement of character quality, and enhancement of fixing ability as intended in the present invention can be obtained.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. No. 4,723,129 and U.S. Pat. No. 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. No. 4,463,359 and U.S. Pat. No. 4,345,262 are preferable. In addition, it is preferable that the rate of temperature rise of the heating portions described in U.S. Pat. No. 4,313,124 be adopted to achieve better recording.

U.S. Pat. No. 4,558,333 and U.S. Pat. No. 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Laid-Open Patent Application Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Laid-Open Patent Application No. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 19:
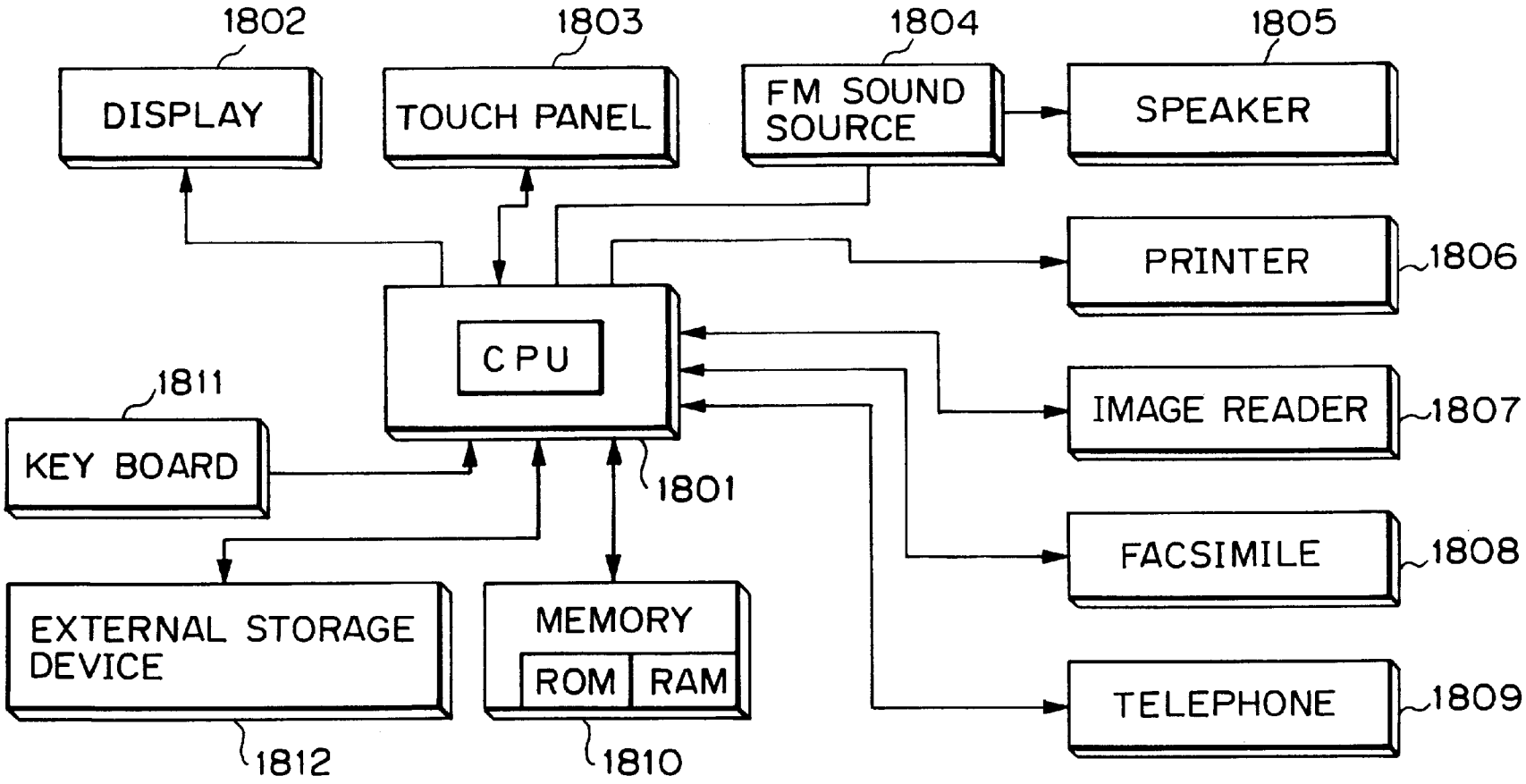
FIG. 19 is a block diagram showing one embodiment of an information processing system which can employ the ink-jet printing apparatus of the embodiments of the present invention.

FIG. 19 is a block diagram showing general construction of an information processing apparatus having a function of wordprocessor, personal computer, facsimile machine, copy machine and so forth, to which the printing apparatus according to the present invention is applied.

In the drawings, a reference numeral 1801 denotes a control portion performing control of the overall apparatus, which includes a CPU, such as a microprocessor and so forth, and various I/O ports, to perform control for outputting the control signal or data signal and so forth to respective portions and inputting the control signal or data signal from the respective portions. A reference numeral 1802 denotes a display portion having a display screen, on which various menus, document information and images or so forth read by an image reader 1807 are displayed. A reference numeral 1803 denotes a transparent pressure sensitive touch panel provided on the display portion 1802 for performing item entry or coordinate position entry on the display portion 1802 by depressing the surface thereof by a finger or so forth.

A reference numeral 1804 denotes an FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically reading out original data for inputting, which is located at the intermediate position in an original feeding path and performs reading of various original documents, such as an original document for facsimile machine or copy machine. A reference numeral 1808 denotes a facsimile (FAX) transmission and reception portion for transmitting original data read by the image reader portion or for receiving a transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application programs and so forth, as well as character fonts, dictionary and so forth, a RAM for storing application programs loaded from an external storage device 1812, document video information and so forth.

A reference numeral 1811 denotes a keyboard portion inputting document information or various commands. A reference numeral 1812 denotes the external storage device employing a floppy disc or hard disc drive as the storage medium. In the external storage device 1812, document information, music or speech information, application programs of the user and so forth are stored.

Figure 20:
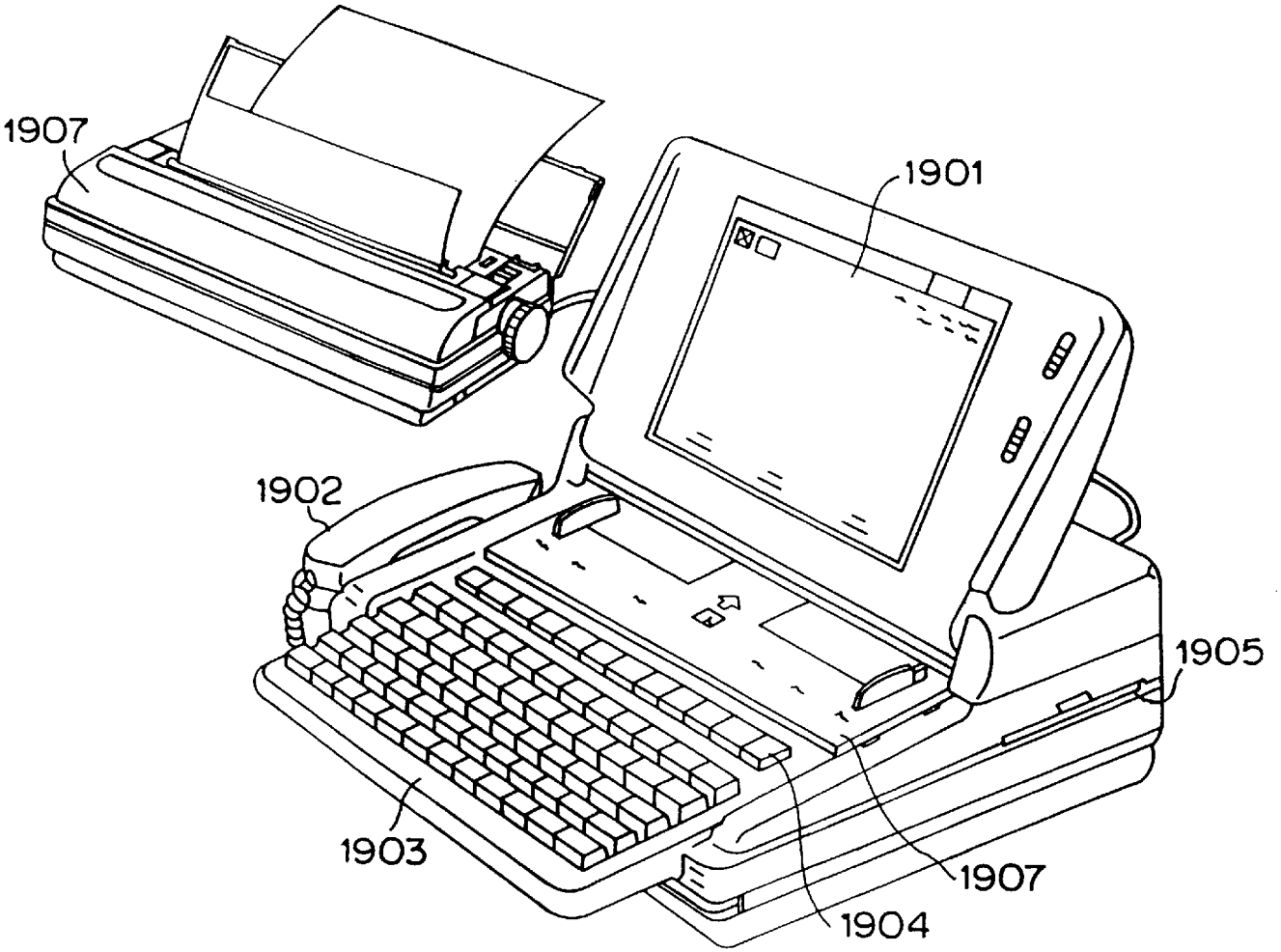
FIG. 20 is perspective view of the system.
Figure 21:
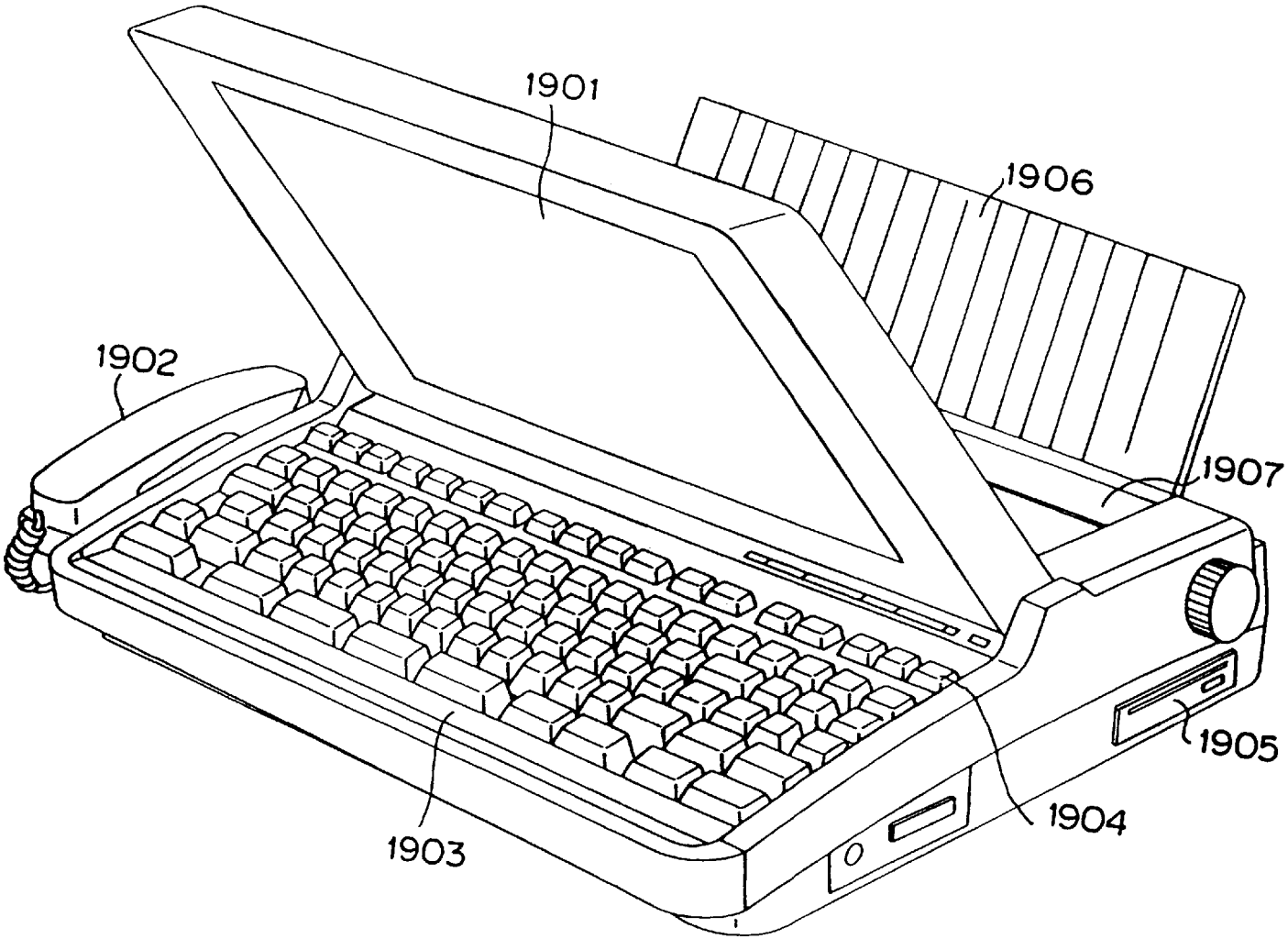
FIG. 21 is perspective view of another embodiment of the system.

FIG. 20 is a diagrammatic external view of the information processing system shown in FIG. 19.

In FIG. 20 a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion port of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth above is operated as the personal computer or the wordprocessor, various information input through the keyboard portion 1811 is processed according to a predetermined program by the control portion 1801 and output as a printed image by the printer portion 1806.

When the information processing apparatus is operated as a receiver of the facsimile machine, facsimile information input from the FAX transmission and reception portion 1808 via a communication network is subject to reception processing according to the predetermined program and output as a received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

It should be noted that the information processing apparatus may be an integrated type incorporating the ink-jet printer within a main body as illustrated in FIG. 20. In this case, portability can be further improved. In FIG. 20, the portions having the same function as those in FIG. 19 are shown with the corresponding reference numerals.

As set forth above, a multi-function type information processing apparatus may obtain a high quality printed image at high speed and low noise by employing the printing apparatus of the present invention. Therefore, the functions of the information processing apparatus can be further enhanced.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for performing printing on a printing medium employing ink ejecting means having a plurality of ink ejection openings to eject an ink and liquid ejecting means having a plurality of liquid ejection openings to eject a liquid containing a material for making a coloring agent in the ink ejected through said ink ejecting means insoluble or for agglomerating, said apparatus comprising:

moving means for moving the ink ejecting means and the liquid ejecting means relative to the printing medium; and control means for controlling said moving means and causing the ink ejecting means and the liquid ejecting means to eject the ink and the liquid, respectively, so as to print a test pattern correspondingly to respective liquid ejection openings of said liquid ejecting means, the test pattern having a first portion on which only ink is applied from an ink ejection opening corresponding to a liquid ejection opening, which does not eject the liquid to print the first portion, and a second portion on which both the ink from the ink ejection opening and the liquid from the liquid ejection opening are applied in an overlaying manner.

2. An ink-jet printing apparatus as claimed in claim 1, wherein the liquid contains low molecular component and high molecular component of cation-type material and the ink contains at least an anion type dye.

3. An ink-jet printing apparatus as claimed in claim 1, wherein the liquid contains low molecular component and high molecular component of cation-type material and the ink contains at least an anion type compound and a pigment.

4. An ink-jet printing apparatus as claimed in claim 1, further comprising means for depositing moisture only on the second portion.

5. An ink-jet printing apparatus as claimed in claim 1, wherein each of said ink ejecting means and said liquid ejecting means has thermal energy generating means for generating a thermal energy to be utilized for ejection of the ink or liquid.

6. An ink-jet printing apparatus as claimed in claim 1, wherein said apparatus is incorporated in a facsimile system.

7. An ink-jet printing apparatus as claimed in claim 1, wherein said apparatus is incorporated in a copy system.

8. An ink-jet printing apparatus as claimed in claim 1, wherein said apparatus is incorporated in a printer.

9. An ink-jet printing apparatus as claimed in claim 1, wherein said apparatus is incorporated in a computer.

10. An ink-jet printing apparatus for performing printing on a printing medium employing ink ejecting means having a plurality of ink ejection openings to eject an ink and liquid ejecting means having a plurality of liquid ejection openings to eject a liquid containing a material for making a coloring agent in the ink ejected through said ink ejecting means insoluble or for agglomerating, said apparatus comprising:

storage means for storing a test pattern to be printed by using said ink ejecting means for ejecting the ink and said liquid ejecting means for ejecting the liquid; and implementing means for performing printing of said test pattern correspondingly to respective liquid ejection openings of said liquid ejecting means, the test pattern having a first portion on which only ink is applied from an ink ejection opening corresponding to a liquid ejection opening, which does not eject the liquid to print the first portion, and a second portion on which both the ink from the ink ejection opening and the liquid from the liquid ejection opening are applied in an overlaying manner.

11. An ink-jet printing apparatus for performing printing on a printing medium employing ink ejecting means for ejecting an ink and liquid ejecting means for ejecting a liquid containing a material for making a coloring agent in the ink ejected through said ink ejecting means insoluble or for agglomerating, said apparatus comprising:

moving means for moving the ink ejecting means and the liquid ejecting means relative to the printing medium; and control means for controlling said moving means and causing the ink ejecting means and the liquid ejecting means to eject the ink and the liquid, respectively, so as to print a test pattern, in which the liquid is ejected at only a predetermined pixel and the ink is ejected at pixels including the predetermined pixel, so that the ink and the liquid are overlaid with each other at the predetermined pixel, wherein said test pattern is a pattern, in which said predetermined pixel is printed with at least one color of the ink ejected by said ink ejecting means and the liquid ejected by said liquid ejecting means, and pixels around said predetermined pixel are printed with said at least one color of the ink ejected by said ink ejecting means.

12. An ink-jet printing apparatus as claimed in claim 11, wherein the printing of said predetermined pixel is to form ruled line patterns respectively corresponding to a plurality of ejection openings of said liquid ejecting means for ejecting the liquid.

13. An ink-jet printing apparatus as claimed in claim 12, wherein said ruled line pattern is formed in a stepwise fashion.

14. An ink-jet printing apparatus for performing printing on a printing medium employing ink ejecting means having a plurality of ink ejection openings to eject an ink and liquid ejecting means having a plurality of liquid ejection openings to eject a liquid containing a material for making a coloring agent in the ink ejected through said ink ejecting means insoluble or for agglomerating, said apparatus comprising:

moving means for moving the ink ejecting means and the liquid ejecting means relative to the printing medium;

control means for controlling said moving means and making the ink ejecting means and the liquid ejecting means eject the ink and the liquid, respectively, so as to print a test pattern correspondingly to respective liquid ejection openings of said liquid ejecting means, the test pattern having a first portion on which only ink is applied from an ink ejection opening corresponding to a liquid ejection opening, which does not eject the liquid to print the first portion, and a second portion on which both the ink from the ink ejection opening and the liquid from the liquid ejection opening are applied in an overlaying manner; and detecting means for detecting said test pattern.

15. An ink-jet printing apparatus for performing printing on a printing medium employing ink ejecting means for ejecting an ink and liquid ejecting means for ejecting a liquid containing a material for making a coloring agent in the ink ejected through said ink ejecting means insoluble or for agglomerating, said apparatus comprising:

moving means for moving the ink ejecting means and the liquid ejecting means relative to the printing medium; and control means for controlling said moving means and causing the ink ejecting means and the liquid ejecting means to eject the ink and the liquid, respectively, so as to print a test pattern, in which the liquid is ejected at only a predetermined pixel and the ink is ejected at pixels including the predetermined pixel, so that the ink and the liquid are overlaid with each other at the predetermined pixel, wherein said ejecting means performs printing in a first printing mode for said predetermined pixel employing said ink ejecting means for ejecting the ink and said liquid ejecting means for ejecting the liquid, and performs printing in a second printing mode for the pixels other than said predetermined pixel employing said ink ejecting means for ejecting the ink.

16. An ink-jet printing apparatus as claimed in claim 15, wherein said ink ejecting means for ejecting the ink and said liquid ejecting means ejecting the liquid respectively have a plurality of ink ejection openings and a plurality of liquid ejecting openings; and said implementing means prints said test pattern by a first printing operation performed by said first and second printing modes using a plurality of combinations of given numbers of ink ejection openings of said ink ejecting means and given numbers of liquid ejecting openings of said liquid ejecting means, and by a second printing operation performed by said second printing mode using a plurality of said ink ejection openings.

17. An ink-jet printing apparatus as claimed in claim 16, wherein said implementing means enables a relative movement between said ink ejecting means and said liquid ejecting means and the printing medium during said first printing operation, and disables a relative movement between said ink ejecting means and said liquid ejecting means and the printing medium during said second printing operation.

18. An ink-jet printing apparatus as claimed in claim 17, wherein said implementing means alternately repeats said first and second printing operations.

19. An ink-jet printing apparatus as claimed in claim 18, wherein said ink ejecting means is capable of ejecting a plurality of kinds of inks.

20. An ink-jet printing apparatus as claimed in claim 19, wherein the liquid contains low molecular component and high molecular component of cation-type material and the ink contains at least an anion type dye.

21. An ink-jet printing apparatus as claimed in claim 19, wherein the liquid contains low molecular component and high molecular component of cation-type material and the ink contains at least an anion type compound and a pigment.

22. A test printing method for performing printing on a printing medium employing ink ejecting means having a plurality of ink ejection openings to eject an ink and liquid ejecting means having a plurality of liquid ejection openings to eject a liquid containing a material for making a coloring agent in the ink ejected through said ink ejecting means insoluble or for agglomerating, said method comprising the steps of:

moving the ink ejecting means and the liquid ejecting means relative to the printing medium; and along with said moving step, causing the ink ejecting means and the liquid ejecting means to eject the ink and the liquid, respectively, so as to print a test pattern correspondingly to respective liquid ejection openings of the liquid ejecting means, the test pattern having a first portion on which only ink is applied from an ink ejection opening corresponding to a liquid ejection opening, which does not eject the liquid to print the first portion, and a second portion on which both the ink from the ink ejection opening and the liquid from the liquid ejection opening are applied in an overlaying manner.

23. A test printing method as claimed in claim 22, wherein said test pattern is a pattern, in which said second portion is printed with at least one color of the ink ejected by said ink ejecting means and the liquid ejected by said liquid ejecting means, and said first portion is printed with said at least one color of the ink ejected by said ink ejecting means.

24. A test printing method as claimed in claim 23, wherein the printing of said second portion is to form ruled line patterns respectively corresponding to a plurality of ejection openings of said liquid ejecting means for ejecting the liquid.

25. A test printing method as claimed in claim 24, wherein said ruled line pattern is formed in a stepwise fashion.

26. A test printing method as claimed in claim 22, wherein said step for printing the test pattern performs printing in a first printing mode for said second portion employing said ink ejecting means for ejecting the ink and said liquid ejecting means for ejecting the liquid, and performs printing in a second printing mode for said first portion employing said ink ejecting means for ejecting the ink.

27. A test printing method as claimed in claim 26, wherein said step for printing the test pattern prints said test pattern by a first printing operation performed by said first and second printing modes using a plurality of combinations of given numbers of ink ejection openings of said ink ejecting means and given numbers of liquid ejecting openings of said liquid ejecting means, and by a second printing operation performed by said second printing mode using a plurality of said ink ejection openings.

28. A test printing method as claimed in claim 27, wherein said step for printing the test pattern enables a relative movement between said ink ejecting means and said liquid ejecting means and the printing medium during said first printing operation, and disables a relative movement between said ink ejecting means and said liquid ejecting means and the printing medium during said second printing operation.

29. A test printing method as claimed in claim 28, wherein said step for printing the test pattern alternately repeats said first and second printing operations.

* * * * *

UNITED STATES PATENT AND TRADEMARK OFFICE

CERTIFICATE OF CORRECTION

PATENT NO. : 5,898,443

DATED : April 27, 1999

INVENTOR(S) : HIROSHI YOSHINO, ET AL.

It is certified that error appears in the above-identified patent and that said Letters Patent is hereby corrected as shown below:

COLUMN 2,
Line 21, "failure-and" should read --failure and--;
Line 27, "ings" should read --ings,--; and
Line 36, "period," should read --period--.

COLUMN 3,
Line 17, "number of" should be deleted; and
Line 51, "an liquid-jet" should read --a liquid-jet--.

COLUMN 6,
Line 24, "referred" should read --be referred--.

COLUMN 7,
Line 60, "later" should read --latter--; and
Line 63, "P4" should read --P4,--.

COLUMN 10,
Line 8, "kinds" should read --kind--.

COLUMN 15,
Line 24, "whereby" should read --thereby--;
Line 47, "referred" should read --referred to--; and
Line 63, "effective" should read --effectively--.

COLUMN 17,
Line 42, "that," should read --that--.

COLUMN 18,
Line 1, "to" should read --as--; and
Line 11, "noted," should read --noted--.

UNITED STATES PATENT AND TRADEMARK OFFICE

CERTIFICATE OF CORRECTION

PATENT NO. : 5,898,443

DATED : April 27, 1999

INVENTOR(S) : HIROSHI YOSHINO, ET AL.

It is certified that error appears in the above-identified patent and that said Letters Patent is hereby corrected as shown below:

COLUMN 24,
Line 56, "correspondingly" should read --having a first portion and a second portion, said test pattern corresponding--;
Line 57, "the test pattern having a" should read --applying only ink on said--;
Line 58, "on which only ink is applied" should read --of the test pattern--;
Line 61, "a second portion on which" should read --applying--; and
Line 63, "are applied" should read --on the second portion--.

Signed and Sealed this

Fourteenth Day of December, 1999

Q. Todd Dickinson

Q. TODD DICKINSON

*Acting Commissioner of Patents and Trademarks*

*Attest:*

*Attesting Officer*